US005531584A

United States Patent [19]

Jacques

[11] Patent Number: 5,531,584

[45] Date of Patent: Jul. 2, 1996

[54] AUTOMATED TROWELLING SYSTEM

[76] Inventor: Carol Jacques, 35 Federal St., Walpole, Mass. 02081

[21] Appl. No.: 331,284

[22] Filed: Oct. 28, 1994

[51] Int. Cl.[6] ..... B28B 11/08

[52] U.S. Cl. ..... 425/221; 425/218; 425/363; 425/367; 425/383; 425/385; 425/469; 404/93

[58] Field of Search ..... 425/383, 385, 425/431, 428, 458, 469, 218, 220, 363, 367, 221, 135; 404/93; 264/284

[56] References Cited

U.S. PATENT DOCUMENTS

| | | | |
|---|---|---|---|
| 1,430,387 | 9/1922 | Krall . | |
| 1,932,319 | 10/1933 | Myers . | |
| 2,326,264 | 8/1943 | Stetler . | |
| 2,674,117 | 4/1954 | Butler . | |
| 2,787,096 | 4/1957 | Riddels et al. . | |
| 3,348,342 | 10/1967 | Zachek . | |
| 4,199,905 | 4/1980 | Neidigh et al. | 51/429 |
| 4,298,555 | 11/1981 | Weltmer | 264/31 |
| 4,372,733 | 2/1983 | Tinning | 425/60 |
| 4,381,911 | 5/1983 | Bell | 425/458 |
| 4,753,590 | 6/1988 | Milholen | 425/385 |
| 4,964,754 | 10/1990 | Garner et al. | 404/123 |
| 4,979,589 | 12/1990 | Sugiyama et al. | 182/38 |
| 5,042,208 | 8/1991 | Richardson | 51/180 |
| 5,046,888 | 9/1991 | King | 404/75 |
| 5,061,115 | 10/1991 | Godbersen et al. | 404/102 |

*Primary Examiner*—Khanh P. Nguyen
*Attorney, Agent, or Firm*—Weingarten, Schurgin, Gagnebin & Hayes

[57] ABSTRACT

An automated trowelling system for providing a smooth, even finish to one or both sides of a wall. The present system smooths wet surface materials such as concrete or plaster quickly and consistently with minimum manual intervention. Horizontal brackets on the wall support a horizontally translating column and an associated vertically reciprocating trowel. A first motor propels the column and trowel laterally along the wall, while a second motor effects vertical motion. A forward scoop removes excess wall finishing material ahead of the reciprocating trowel, and a nonreciprocating finish trowel follows the reciprocating trowel to provide an enhanced finish to the wall. A processing unit enhances the ability of the system to operate with minimum manual intervention. Sensors provide input to the processing unit.

45 Claims, 20 Drawing Sheets

AUTOMATED TROWELLING SYSTEM

FIELD OF THE INVENTION

The present invention relates to systems for trowelling walls having an initially fluent surface, and specifically to such trowelling systems operative along a frame providing planar system motion.

BACKGROUND OF THE INVENTION

In many building construction situations, it is necessary to provide a smooth appearance to walls having a finish material that is applied "wet" or in a fluent state. Such materials include, for example, concrete and plaster. While it is possible to sand or polish these materials after they have dried to provide the desired smooth, even surface, it is time consuming and expensive to finish the dried material since such material is necessarily dense and resistant to abrasion.

In pursuit of even, finished walls, one common practice involves the use of a manually operated spray gun with which an operator attempts to apply an even distribution of material to a wall structure. However, the material so applied, such as concrete, is invariably rough and uneven. In typical construction situations, material applications must cover walls of twenty feet in height. Therefore, it is difficult to provide a consistent depth of concrete over a significant portion of the wall using such a manually operated and directed spray gun.

Thus, it is also common practice to employ teams of manual laborers to draw trowels, sometimes of considerable size, over such manually applied surfaces of concrete or plaster. In situations involving high walls, scaffolding must be provided to enable such hand trowelling. This practice is quite obviously time consuming and labor-intensive, and therefore expensive, while still posing a challenge in the provision of even finishes over large surfaces.

While other means have been proposed for finishing surfaces lying in a horizontal plane with less reliance on manual intervention, none have provided rapid, simplified finishing of a vertical wall along both vertical and horizontal axes resulting in a consistently smooth finish with minimal reliance on manual intervention.

SUMMARY OF THE INVENTION

The present invention provides an automated trowelling system for providing a smooth, even finish to one or both sides of a wall. Contrary to prior art trowelling means, the present system can smooth wet surface materials such as concrete or plaster quickly and consistently with a minimum of manual intervention.

Horizontal brackets along upper and lower edges of the wall to be finished provide support to a vertical support column which is capable of horizontal translation along the brackets. Attached to the vertical support column is a vertically reciprocating trowel. A first source of motive power in cooperation with the horizontal brackets propels the support column and associated vertical trowel laterally along the length of the wall, while a second source of motive power is coupled to the vertical trowel for effecting the reciprocating vertical motion. A controller, such as a manual remote control or an automated processor having associated memory and algorithms, manages the operation of the wall finishing system.

In an alternative embodiment, a forward scoop is employed ahead of the vertically reciprocating trowel to remove excess wall finishing material from the wall. In a further alternative embodiment, a nonreciprocating finish trowel follows the reciprocating vertical trowel along the vertical surface of the wall to provide an enhanced finish. Safety equipment such as audible and visual annunciators are provided to notify workers in the proximity of the wall finishing system that it is in motion. A number of sensors provide feedback regarding the operating condition of the system, including physical location of the system along the wall to be finished and condition of the material to be finished.

Thus, the presently disclosed invention provides rapid and consistent finishing of fluent wall finish materials with a minimum of manual intervention.

BRIEF DESCRIPTION OF THE DRAWINGS

These and other features of the present invention are more fully set forth below in the fully exemplary detailed description and accompanying drawings of which.

DETAILED DESCRIPTION

Figure 1:
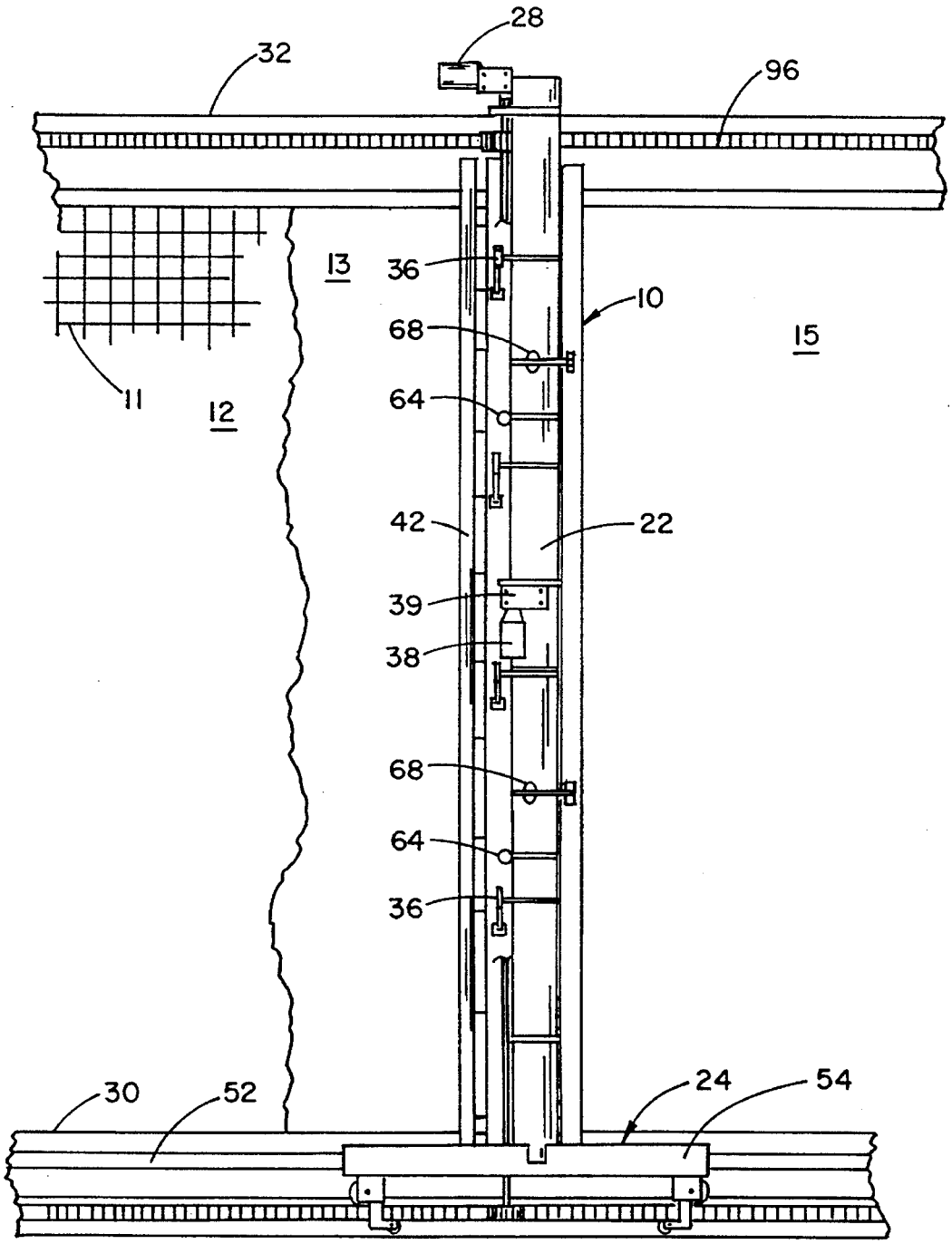
FIG. 1 is a front view of an automated trowelling system according to the present invention in an illustrative environment.

With reference first to FIG. 1, an automated trowelling system 10 according to the present invention operates proximate a planar, vertical wall to be finished 12 (only partially illustrated) along both horizontal and vertical axes to provide a desired surface texture and appearance to fluent material which has been applied to the wall 12. In FIG. 1, three regions of a wall are illustrated. In a first region 11, no finishing material has been applied. In a second region 13, finishing material has been applied, for instance by a manually operated spray gun, but the material has not been finished to provide a smooth surface. Finally, in a third region 15, the trowelling system 10 according to the present invention has provided the material with a smooth finish.

Figure 2:
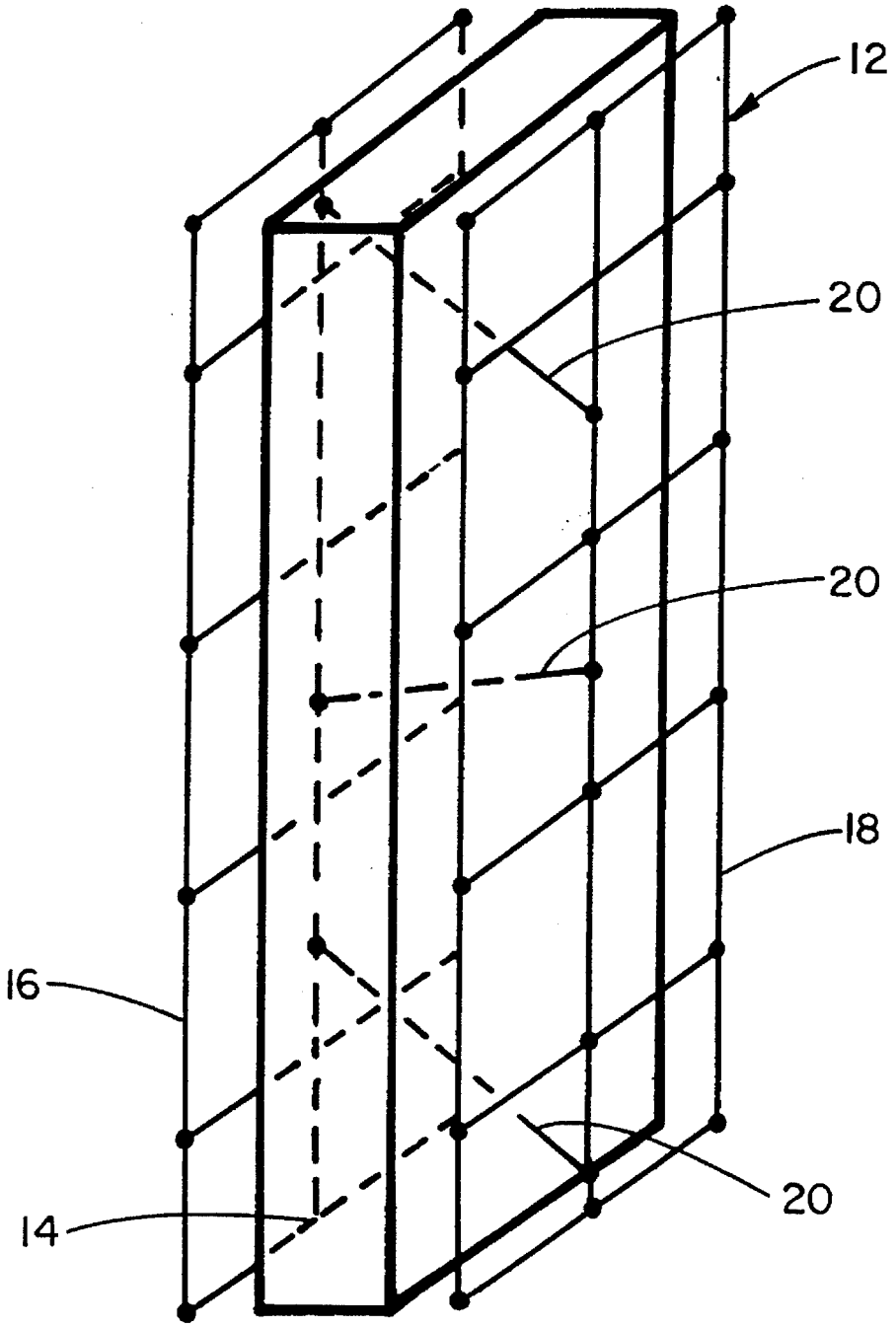
FIG. 2 is a perspective view of a portion of a wall system on which the trowelling system of FIG. 1 is employed.

As better illustrated in FIG. 2, the wall to be finished 12 can be a composite wall system comprised of a central core 14 of styrofoam or other lightweight, insulative material, sandwiched between identical wire grid screens 16, 18. Typical dimensions for the composite wall 12 components are a four inch thickness for the styrofoam central core 14 and an inch between each grid 16, 18 and the central core 14. Another set of typical dimensions are a central core 14 of two and a half inches, and two-thirds of an inch on either side of the central core 14 to each grid 16, 18. Further variations are possible, depending on the geographic location of the construction site, whether the wall to be constructed has an exterior exposure, and on the material used for the central core 14 and the grid 16, 18, among other considerations.

In the illustrated embodiment of FIG. 2, lateral support is provided to the wall 12 by cross members 20. These members 20 extend between the respective grids 16, 18, through the central core 14. The number of cross members 20 also depends upon various factors relating to wall location, thickness, composition, and load-bearing requirements. The composite wall 12 of FIG. 2 can be any of a variety of heights, including twenty feet, a common measurement in many current construction settings. Further, composite wall panels such as that illustrated can be provided in standard or custom lengths, or can be easily custom cut at the construction site.

Figure 5:
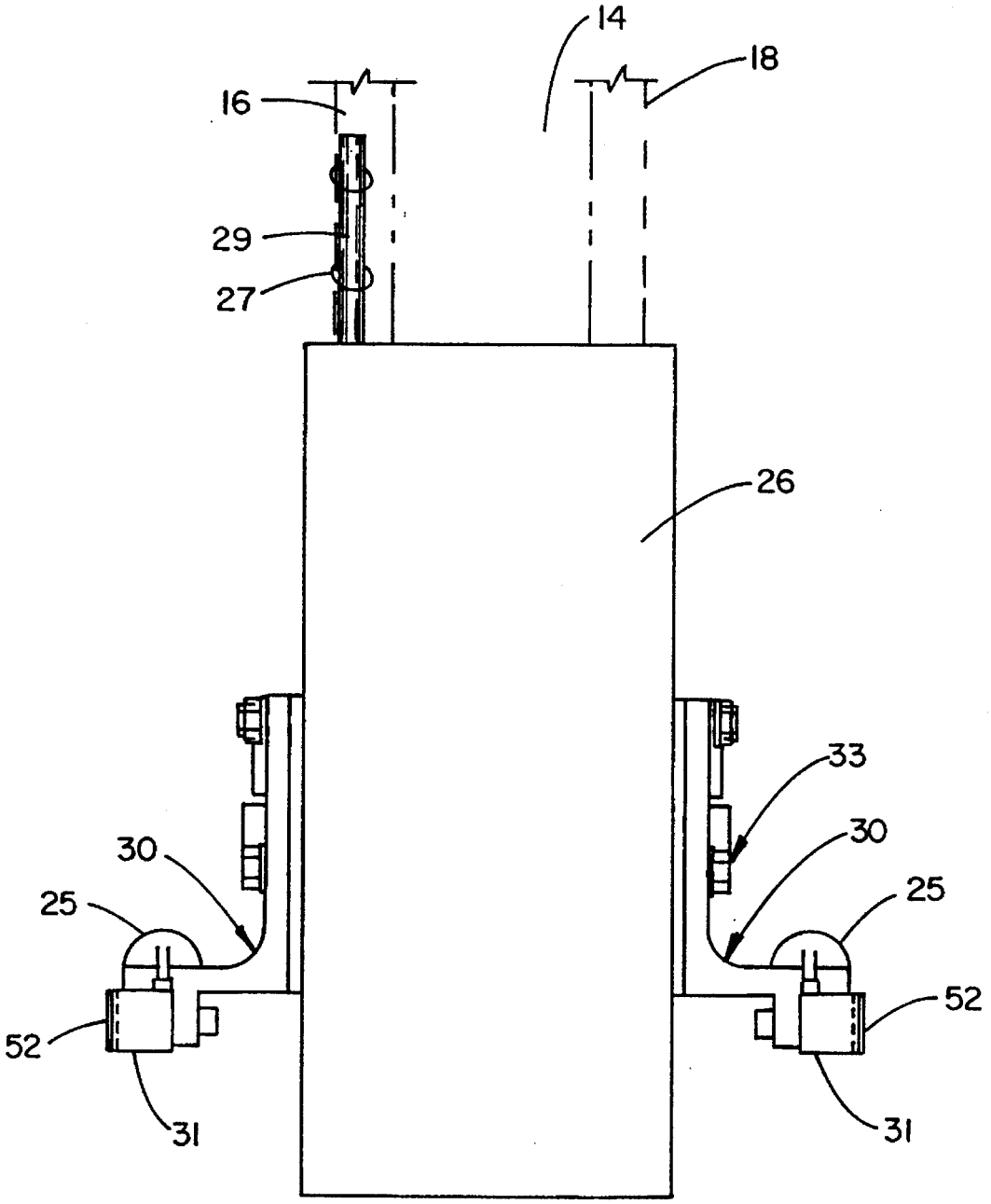
FIG. 5 is a cross-sectional view of a lower section of the wall system of FIG. 2 mounted on a footer.

As shown in FIG. 5, each wall system 12 panel is attached to a footer 26 which is typically twenty-four inches tall. The footer is commonly poured concrete. The attachment of the wall system 12 is achieved by a plurality of vertical rods 29 extending from the footer 26 such that when the wall system 12 is put in place on the footer 26, the rods 29 are just within the wire grid screen 16 and extend vertically along a lower portion of the screen 16. Thereafter, fastening means 27 such as lengths of wire, commonly referred to as tie wires, are employed to bind the wire grid screen 16 to the rods 29. A plurality of these rods 29 extends along the horizontal length of the footer 26 at regular intervals. Note that while the rods 29 are illustrated to the left-most screen 16, they could also be attached to the right-most screen 18, or to both screens 16, 18.

In the construction of a concrete wall employing the automated trowelling system 10 of the present invention, the above described wall system 12 is desirable in that it is highly insulative, sound dampening, light, and easy to fabricate and place at a work site. However, the trowelling system 10 of the present invention can also be used to finish plaster or other surface coatings on a flat wall surface, on lath, or to any other wall reinforcement structure such as wire screens (eg. chicken wire) or reinforcing metal bars (known as rebars). A requisite of the wall to be finished is that it is capable of supporting the finishing material as the trowelling system cuts off excess and smooths the remaining material.

Having described a wall structure 12 on which the present invention operates, the trowelling system 10 itself will now be described in detail. Note that variations in exact dimensions and embodiments can be made while still providing the basic elements of the present automated trowelling system 10. Note further that the present trowelling system 10 operates on a wall structure 12 once concrete or other fluent material has been applied by conventional means, such as by use of a manually operated spray gun, or by other specialized means.

The automated trowelling system 10 is comprised of several main components, as described again with respect to FIG. 1. Further details of the various components of the trowelling system 10 are described with respect to the remaining figures. A vertical support column 22 extends between a lower brace 24 and an upper mounting plate 98 (visible in FIG. 8), proximate and parallel to the wall 12. The entire trowelling system 10 is moved laterally (to the left in the illustrated embodiment of FIG. 1), proximate the wall 12, suspended between lower and upper brackets 30, 32. A first motor 28 provides the power for moving the trowelling system 10 laterally. The brackets 30, 32 are attached to the wall 12 (either the composite wall illustrated in FIG. 2 or another form of wall) as described in further detail below, and extend the length of the wall 12.

A main trowel 34 is attached to the vertical support column by way of multiple reel springs 36. A second motor 38 is connected through linkage 40 to the main trowel 34 and imparts vertically reciprocating motion to the main trowel 34. The reel springs 36 each provide a metal band wound about a spring biased shaft within the reel housing such that when an end of the metal band is extended away from the reel, an increasing tendency to retract is experienced. In the illustrative embodiment of the present system shown in FIG. 1, four pairs of reel springs are disposed along the height of the vertical support column 22, though it is preferred that five such pairs be employed. Each metal band free end is attached to the main trowel 34, such that the reel springs tend to counterbalance the main trowel 34, enabling vertical reciprocal motion of the main trowel 34 using only a small second motor 38. In alternative embodiments of the present invention, the reel-springs are replaced with springs, compressed air cylinders, or the like, each tending to urge the main trowel 34 back to a neutral vertical position, and thus assisting in the reciprocating motion imparted by the second motor 38. Other configurations are possible, including the use of one reel-spring or other resilient member at each location, depending upon the height of the vertical support column 22, the finishing material to be smoothed, and the type of resilient members 36 chosen.

A forward scoop 42 is mounted on the main trowel 34. As the trowelling system 10 moves laterally along the wall 12, excess wall finishing material (eg. concrete) is removed by the forward scoop 42, and is channeled to the floor beneath the lower brace 24. Typically, the forward scoop 42 removes all but ⅛ inch of excess material. The remaining excess is compacted by the reciprocating motion of the main trowel 34. Thus, the main trowel 34 not only smooths the wall finishing material, but also provides a higher degree of compaction, resulting in a more dense layer of finishing material with less trapped air.

A finish trowel 44 is also provided on the trowelling system 10. This trowel 44 is attached directly to the vertical support column 22 and does not vertically reciprocate with the main trowel 34. Rather, as the system 10 moves laterally, the vertically stationary finish trowel 44 serves to smooth any periodic patterns which may be produced by the motion of the main trowel 34. Note that in an alternative embodiment of the automated trowelling system 10 of the present invention, the finishing trowel 44 has a textured surface for creating patterns in the fluent material as the finish trowel 44 is drawn across it. Further, the planar finish trowel 44 can be replaced with a cylindrical roller having a pattern cut into it for the creation of a repetitive pattern on the finished wall 12.

Figure 3:
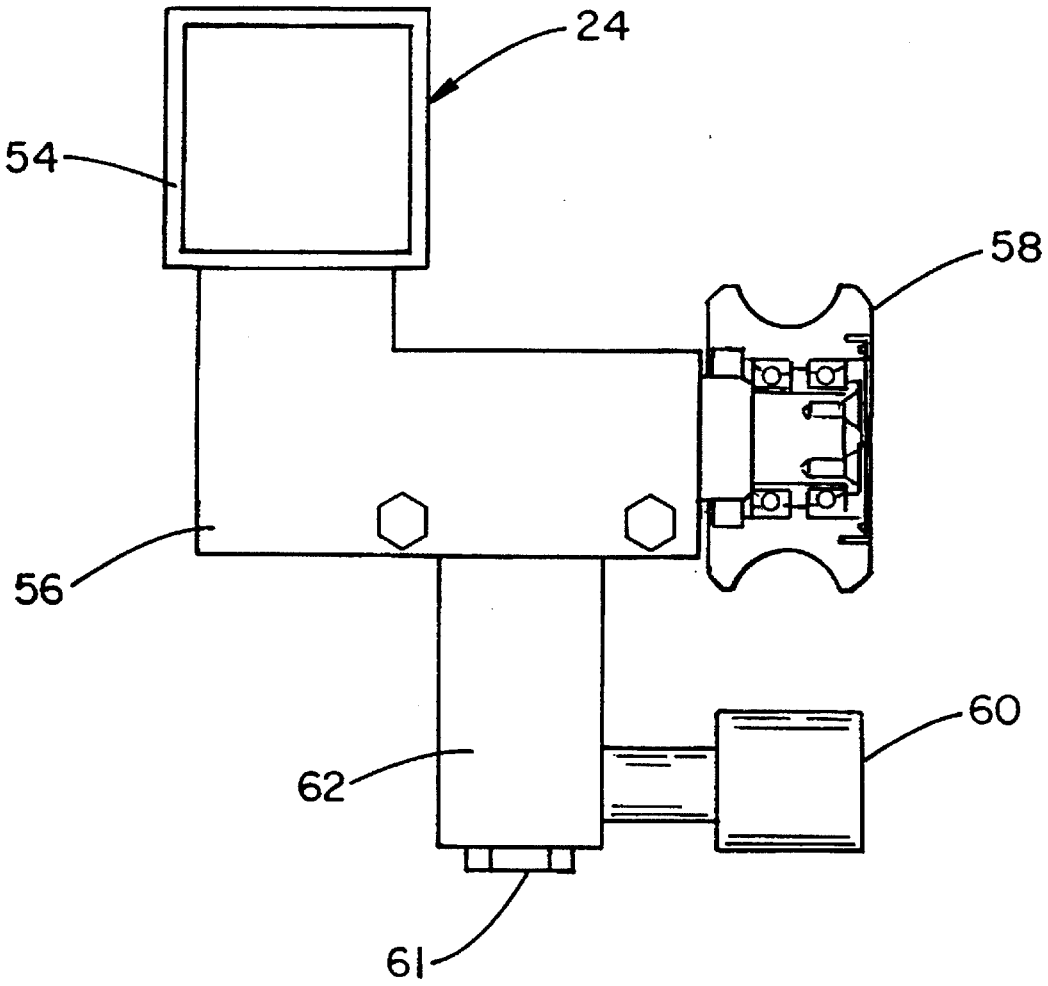
FIG. 3 is a side view of a lower brace of the trowelling system of FIG. 1.
Figure 4:
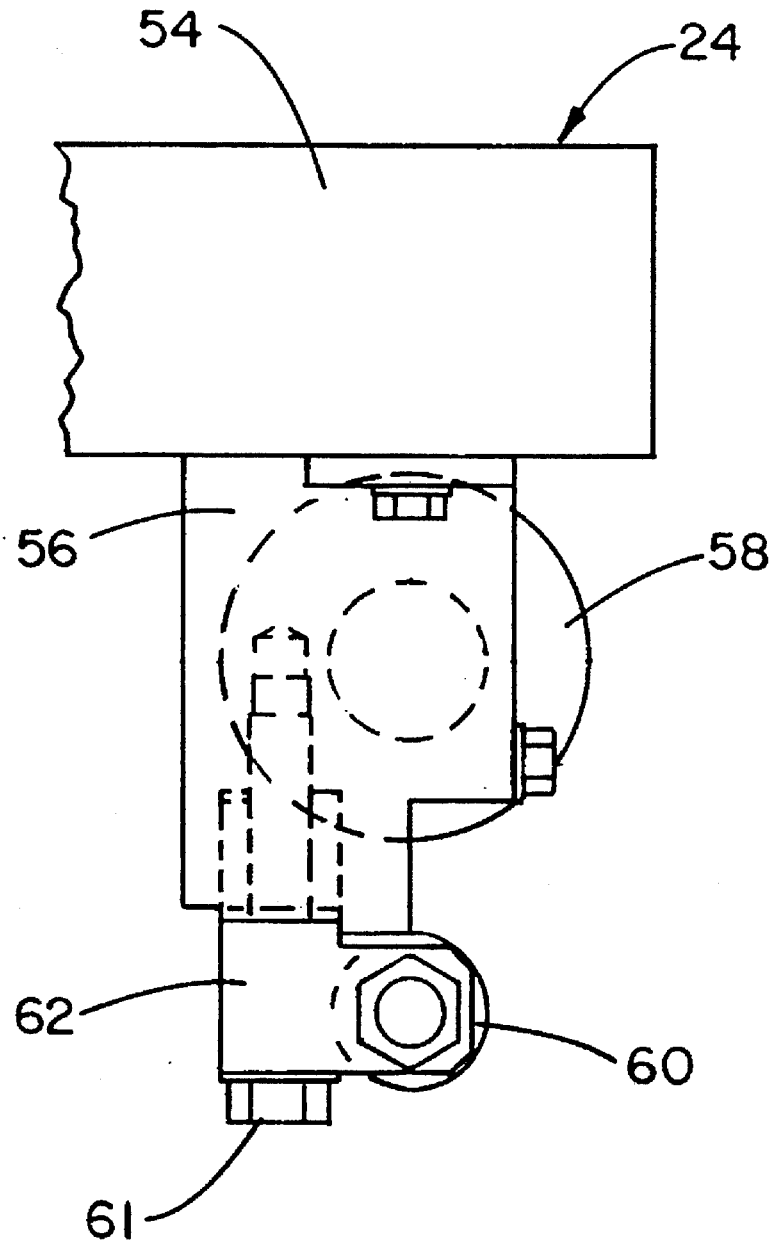
FIG. 4 is a rear view of one end of the lower brace of FIG. 3.

An end view and a front view of one end of the lower brace 24 of the trowelling system 10 are illustrated in FIGS. 3 and 4, respectively. The lower brace 24 has a horizontal member 54 which extends the length of the lower brace 24. Extending from a lower surface of the horizontal member 54 at each end thereof is a lower wheel support 56. Each of the lower supports 56 has a lower wheel 58 disposed thereon, such that the entire automated trowelling system is supported from below by the two lower wheels 58, which ride on a cooperating ridge 25 formed in the lower bracket 30 as shown in FIG. 5.

Further provided on the lower wheel support 56 is a lower follower wheel support 62 having a lower follower wheel 60 extending therefrom. The lower follower wheel 60, disposed below each respective lower wheel 58, is brought into contact or into close proximity with an underside 31 of the cooperating ridge 25 by the manipulation of a lower follower wheel adjustment screw 61. This prevents the lower wheel 58, and therefore the entire automated trowelling system 10, from becoming disengaged from the cooperating ridge 25 of the lower bracket 30.

If the wall to be finished 12 is of the wire grid-styrofoam composite type discussed with respect to FIG. 2, both sides of the wall 12 will need an application of finishing material, and thus will require use of the trowelling system 10 of the present disclosure. In order to increase efficiency, it is preferred, though not necessary, to attach lower brackets 30 to both sides of the footer 26 prior to commencing work on a first side. In FIG. 5, a number of lower bracket screws 33 are visible, and are distributed along the lower bracket as required based upon the load expected to be supported by the lower bracket 30 as a result of the movement of the trowelling system 10 or any other equipment utilizing the bracket 30. Consecutive sections of lower brackets 30 can joined by use of connecting plates (not shown) which are rigidly affixed to the brackets 30, thus enabling smooth progression of the wall system 10 along the wall 12.

Figure 6:
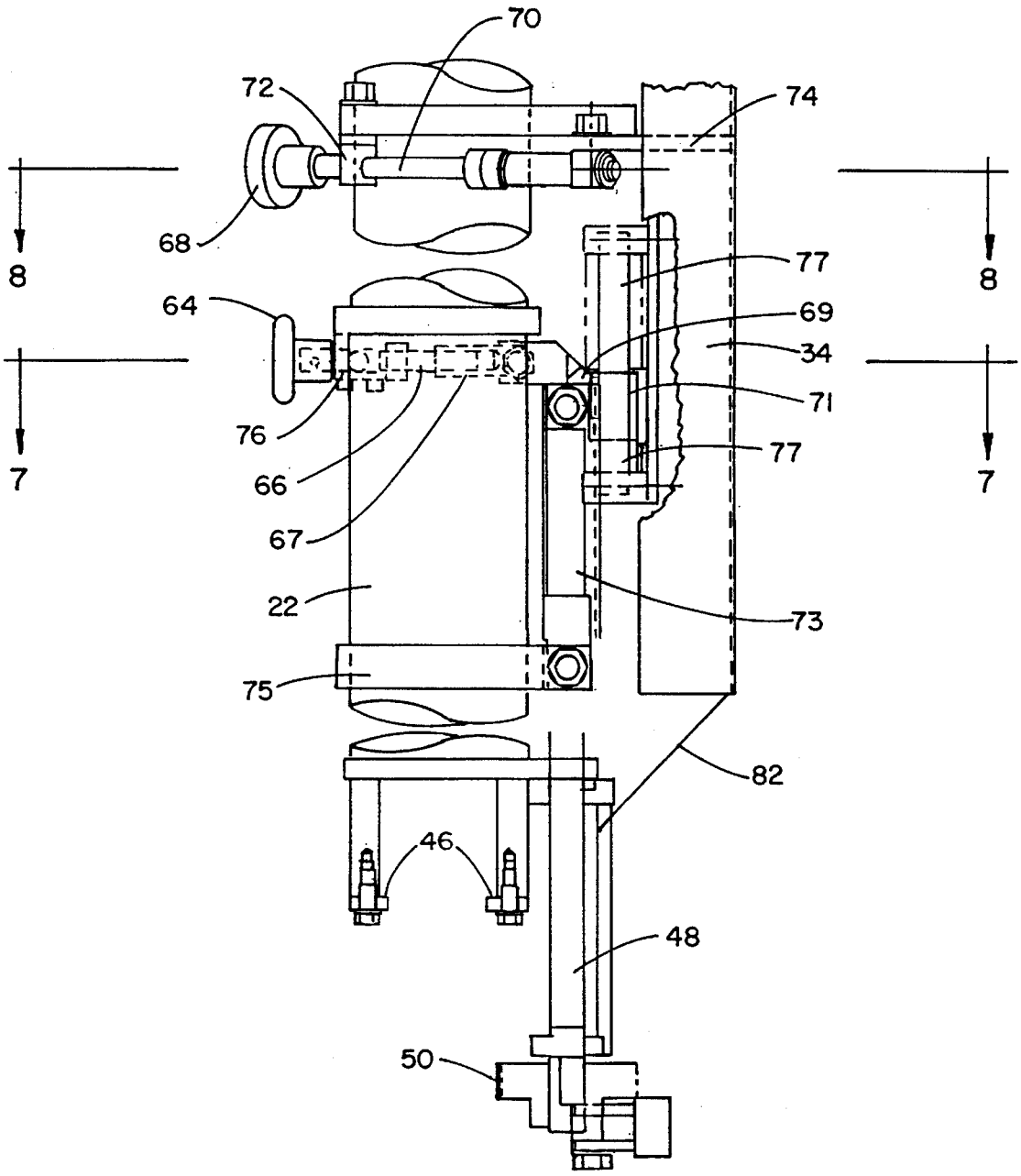
FIG. 6 is a side view of a lower third of elements of the trowelling system of FIG. 1.

A side view of a lower third of the vertical support column 22 and associated elements of FIG. 1 is illustrated in FIG. 6. The lower brace 24, as shown in FIGS. 3 and 4 and which would normally be captured by lower brace clamps 46, has been omitted for the sake of clarity. A drive shaft 48 is partially shown extending parallel to the vertical support column 22. This drive shaft 48 is driven by the first motor 28 (preferably located proximate a top end of the vertical support column 22), and terminates at a lower end in a lower drive gear 50. The lower drive gear 50 meshes with a cooperating lower drive track 52 (see FIG. 5) such that rotation of the lower drive gear 50 by the first drive motor 28 via the drive shaft 48 causes horizontal propulsion of the trowelling system 10 along the wall 12. Note that the lower drive track 52 is proximate the underside 31 of the cooperating ridge 25 on which the lower wheel 58 rides.

With reference again to FIG. 6, provided proximate the vertical support column 22 is at least one main trowel adjustment handle 64. The purpose of this handle 64 is to adjust the distance between the vertical column 22 and the main trowel 34 or, in other words, between the main trowel 34 and the wall 12. A threaded member 66 is attached to the adjustment handle 64 so that when the handle 64 is turned clockwise in an illustrative embodiment, the threaded member 66 advances toward the wall to be finished 12, and thus urges the main trowel 34 to which it is attached to likewise advance toward the wall 12. The handle can have gradations formed therein or a gauge associated therewith to enable accurate adjustment of the main trowel 34 position.

The threaded member 66 passes through a mounting point 76 disposed on the vertical support column 22, while the opposite end of the threaded member 66 is threaded into a receiving nut 67. Disposed between the threaded nut 67 and the main trowel 34 is a horizontal plate 69 having two vertically oriented and pivotable cylindrical bearings 71. Through each of these bearings 71 passes a vibratory shaft 77 rigidly affixed to the main trowel 34. Pivotally connected to the horizontal plate 69 proximate each cylindrical bearing 71 is a substantially vertical bar 73 having a lower pivotable connection to a fixed vertical support column collar 75. Thus, clockwise rotation of the adjustment handle 64 causes the receiving nut 67 to be drawn toward the handle 64. This in turn draws the horizontal plate 69, the bearings 71, the vibratory shafts 71 and the attached main trowel 34 toward the support column 22. Support for this adjustment configuration is provided by the vertical bars 73, the upper ends of which describe a small radius arc as the main trowel 34 is urged toward the support column 22. Turning the adjustment handle the opposite direction causes the main trowel 34 to move towards the wall 12. In one embodiment of the present invention, two such adjustment handles 64 and associated elements are provided, though more can be accommodated.

Figure 7:
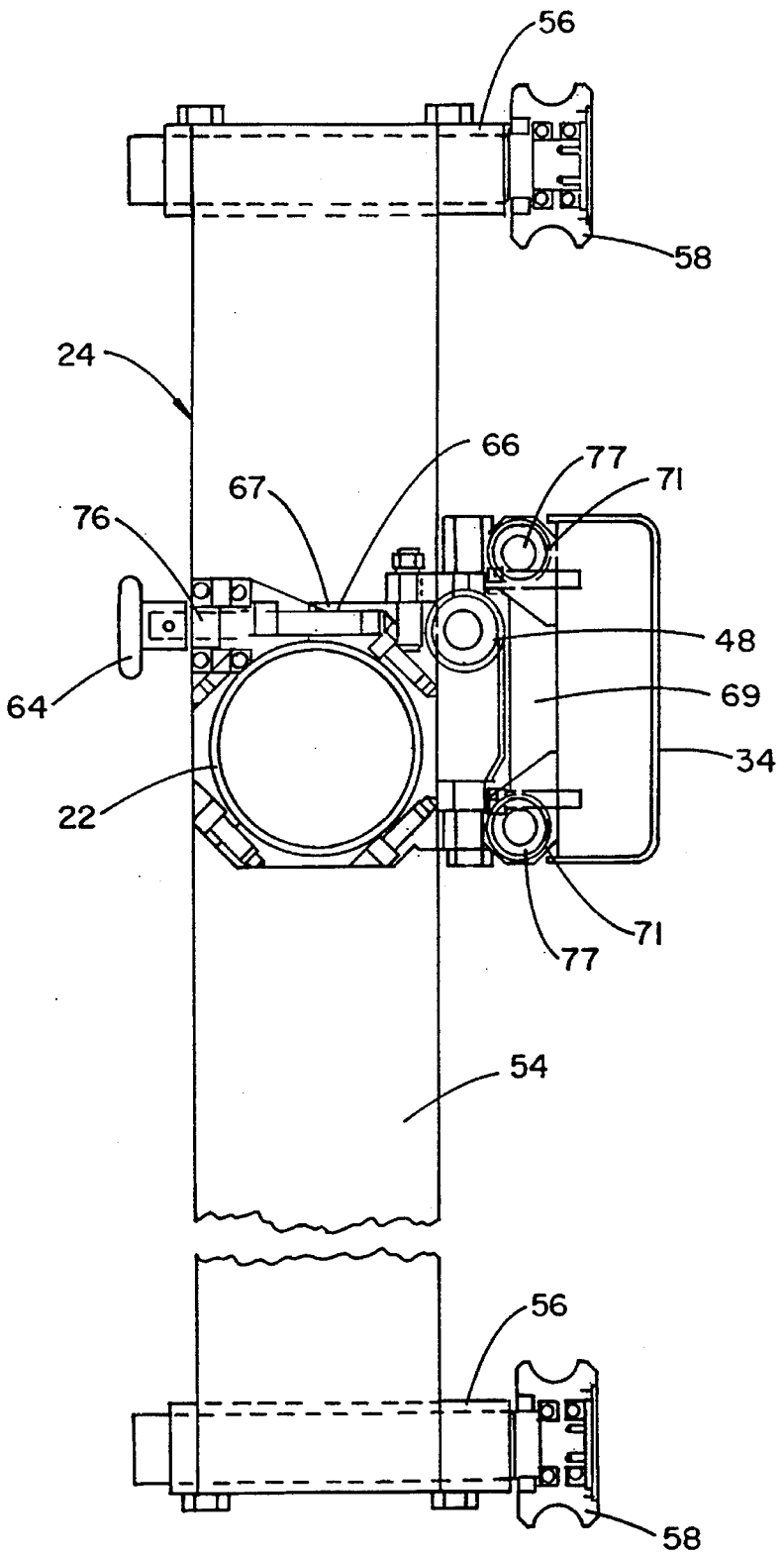
FIG. 7 is a plan view of the trowelling system of FIG. 6 taken along lines 7—7.

In FIG. 7, a top perspective view of the trowelling system 10 provides a view of the main trowel adjustment handle 64 and associated elements, as well as those portions of the trowelling system 12 below it. Note that to eliminate congestion in the drawing, the finish trowel 44 and the forward scoop 42 have been omitted. FIG. 7 further illustrates the relative disposition of the drive shaft 48 with the vertical support column 22. Note that the horizontal plate 69 is configured to avoid interference with the vertical drive shaft 48.

Figure 8:
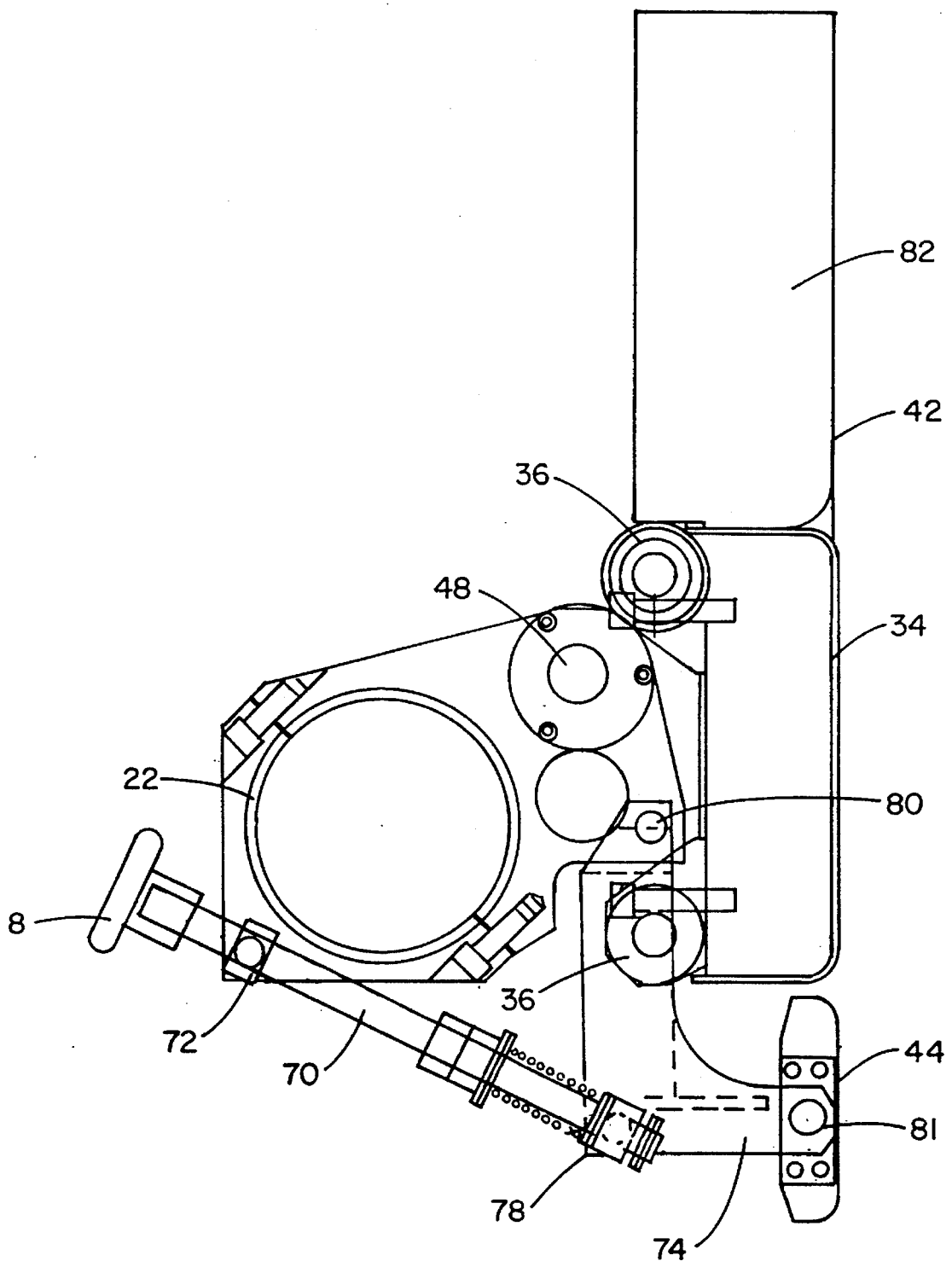
FIG. 8 is a plan view of the trowelling system of FIG. 6 taken along lines 8—8.

FIG. 8 is a top perspective view of the automated trowelling system in which the lower brace 24 of the trowelling system 10, and elements associated therewith, have been omitted. However, the finish trowel 44 and the forward scoop 42 have been included along with the main trowel 34. With reference to FIGS. 6 and 8, another handle attached to the vertical support column 22 is the finish trowel adjustment handle 68. As with the main trowel adjustment handle 64, the finish trowel adjustment handle 68 is attached to a threaded member 70 having one end passing through a mounting point 72 disposed on the vertical support column 22, and having the other end rotatably captured by a threaded pivoting nut 78 disposed on a finish trowel mounting bracket 74. A pivot point 80 is provided between the finish trowel mounting bracket 74 and the remainder of the automated trowelling system 10 such that, as the threaded member 70 is rotated counterclockwise, forcing the threaded pivoting nut 78 toward the wall 12, the mounting bracket 74 is likewise urged forward, thus increasing the pressure applied by the finish trowel 44 on the wall 12. The finish trowel 44 mates with the mounting bracket 74 at a second pivot point 81, allowing the finish trowel 44 to remain flat against the wall 12.

Attached to the main trowel 34 proximate the wall 12 and opposite the finish trowel 44 is the forward scoop 42. Note that in the perspective view of FIG. 8, the entire forward scoop is illustrated, including an angled portion 82 located proximate the lower end of the vertical support column 22. This angled portion 82 slopes down and to the left in the illustrated view. Thus, as the forward scoop 42 removes excess finish material from the surface of the wall 12 before the remaining material is smoothed by the main trowel 34, the excess is channeled by gravity and by the forward scoop 42 toward the floor beneath the lower brace 24. To avoid allowing the excess finish material from fouling the lower wheels 58 and/or the lower drive gear 50 and lower drive track 52, the angled portion 82 urges the excess away from the wall and these moving parts.

Figure 9:
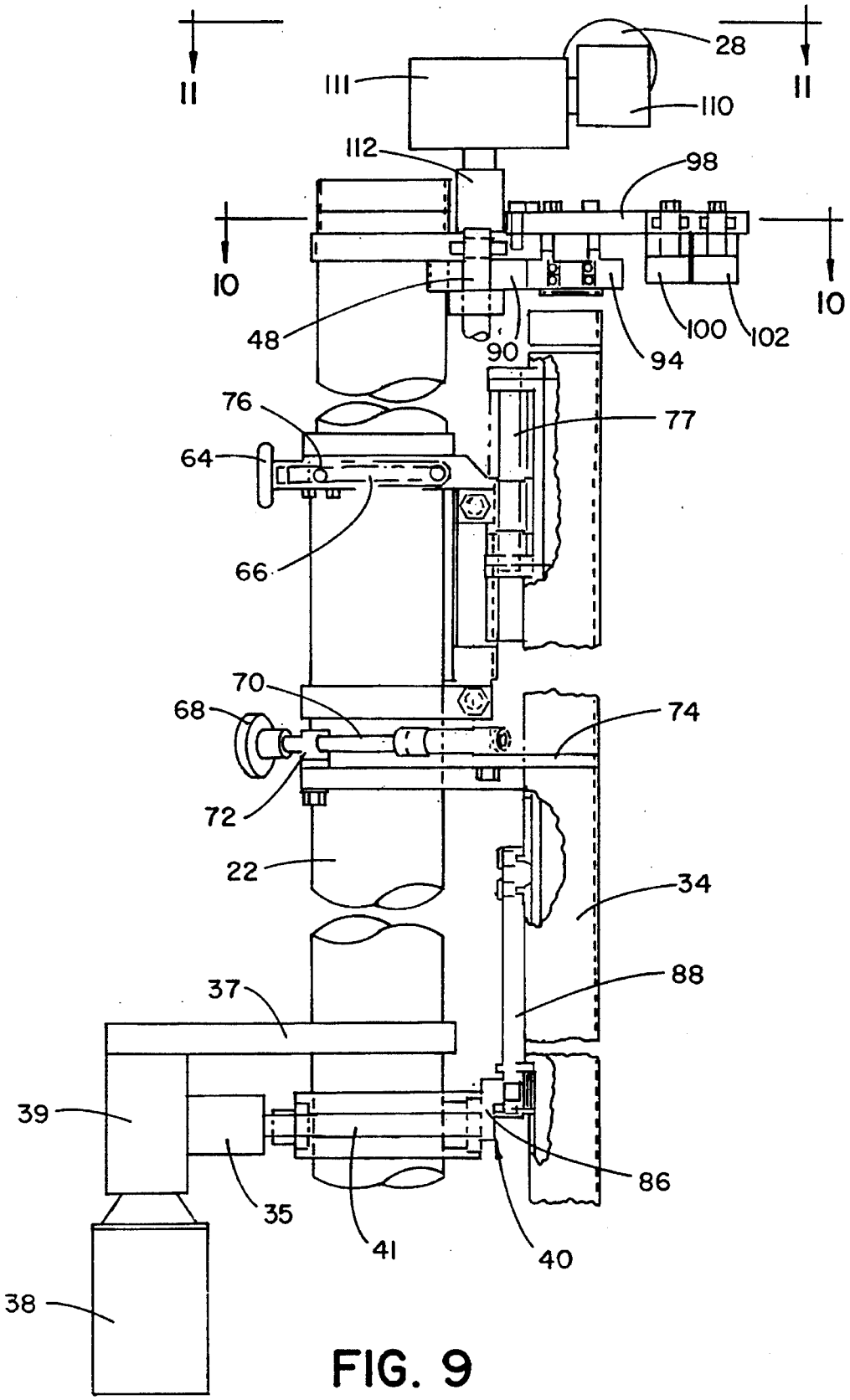
FIG. 9 is a side view of an upper two-thirds of elements of the trowelling system of FIG. 1.

The remaining upper two-thirds of the vertical support column 22 and associated elements are illustrated in FIG. 9. Further main trowel and finish trowel adjustment handles 64, 68 and associated hardware are illustrated, as introduced in FIG. 6. The second motor 38 is also shown which imparts vertically reciprocating motion on the main trowel 34 and associated forward scoop 42. The second motor 38 is attached to the vertical support column 22 by a second motor bracket 37 via a second motor gearbox 39. The gearbox 39 is coupled to an axle 41 via a coupler 35 which provides a plastic interface between the axle 41 and a shaft extending from the gearbox 39. The plastic interface eliminates the possibility that the two metal shafts will wear each other down. The linkage 40 disposed between the second motor 38 and the main trowel 34 includes: a rotating arm 86 rotated by the axle 41; and a reciprocating arm 88, a first end of which is connected to the rotating arm 86 and a second end of which is connected to the main trowel 34. Thus, as the first end of the reciprocating arm 88 tracks the rotating arm 86, the second end and the main trowel 34 are driven up and down, assisted by the latent energy stored in the multiple reel springs 36. The second motor 38 operates at 116 rpm in an illustrative embodiment.

Figure 10:
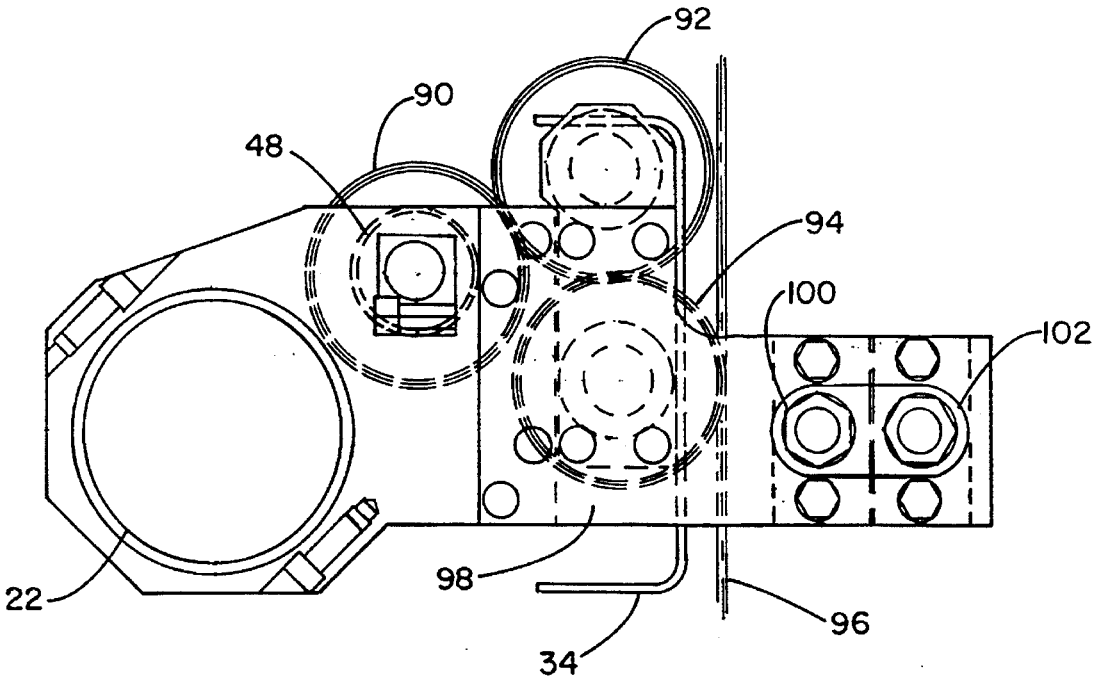
FIG. 10 is a top view of the trowelling system of FIG. 9 taken along lines 10—10.

A first upper drive gear 90, disposed at a top end of the drive shaft 48, is located proximate an upper end of the vertical support column 22. As viewed in FIGS. 9 and 10, teeth of the first upper drive gear 90 cooperate with teeth on an idler gear 92 which is suspended from an upper mounting plate 98. The rotation imparted on the idler gear 92 in turn causes a second upper drive gear 94 to rotate in the same direction as the first upper drive gear 90 and the drive shaft 48. As with the lower drive gear 50, teeth on the second upper drive gear 94 mesh with teeth provided on an upper drive track 96, shown in FIG. 13.

Note that the lower drive gear 50, the first upper drive gear 90 and the second upper drive gear 94 must be of the same diameter; the first and second upper drive gears 90, 94 and the idler gear 92 must be sized such that the rate of angular rotation of the second upper drive gear 94 is equal to that of the lower drive gear 50. Thus, as the drive shaft 48 is rotated, both the lower drive gear 50 and the second upper drive gear 94 progress along respective lower and upper drive tracks 52, 96 simultaneously, propelling the automated trowelling system 10 horizontally.

Figure 11:
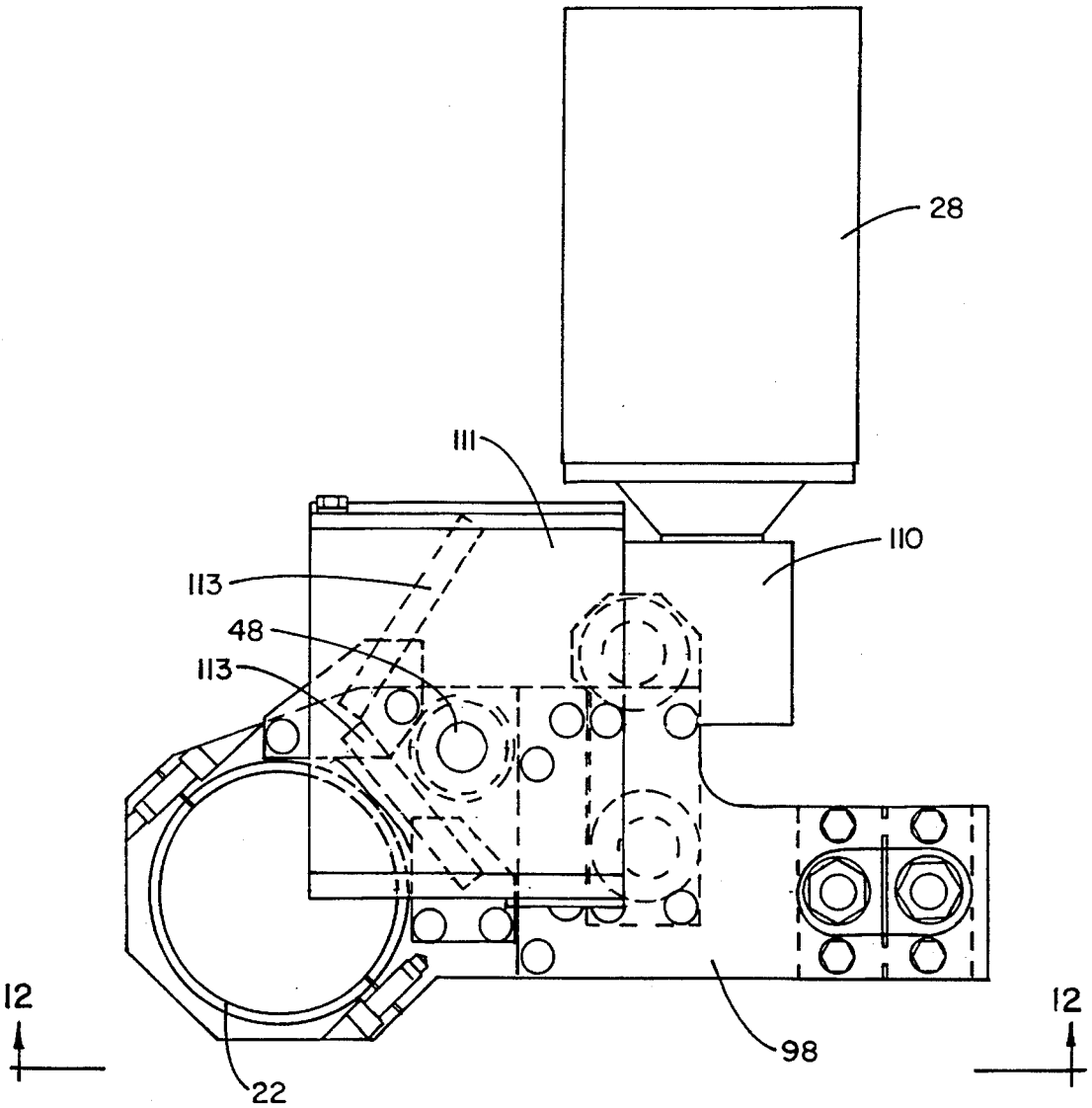
FIG. 11 is a top view of the trowelling system of FIG. 9 taken along lines 11—11.
Figure 12:
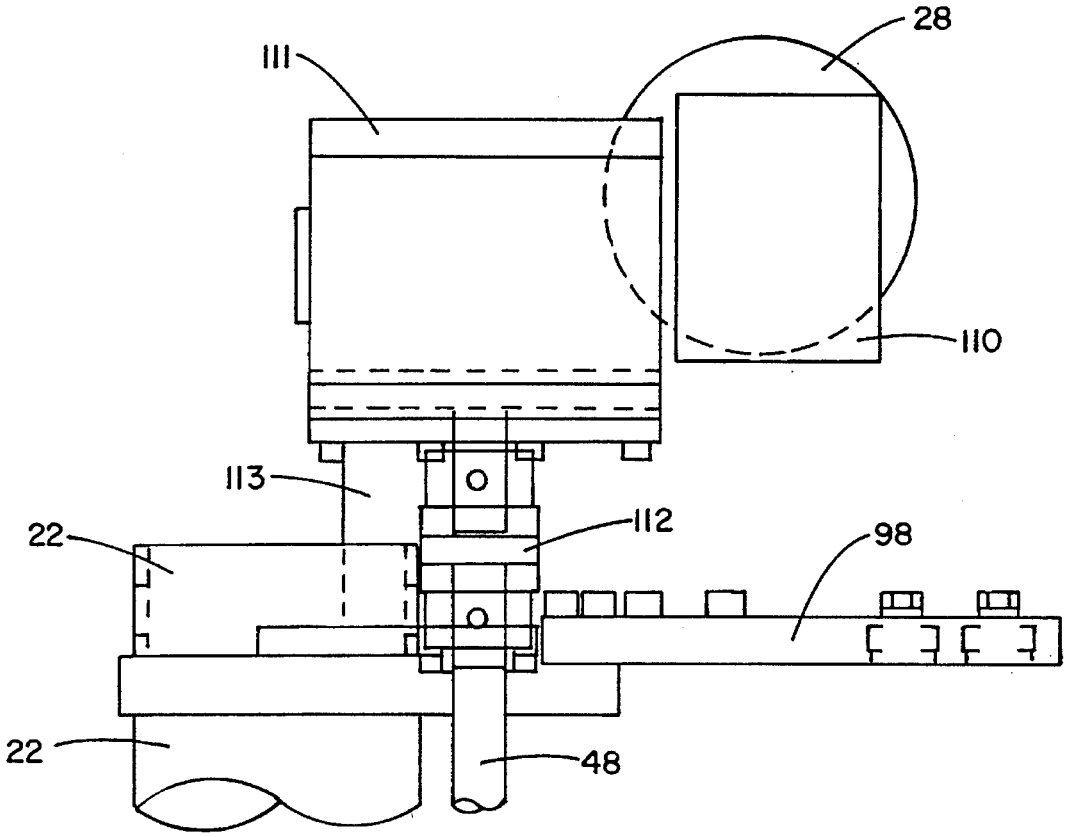
FIG. 12 is a side view of a first motor and associated elements taken along lines 12—12 in FIG. 11.

The first motor 28 is shown in FIGS. 11 and 12 atop the vertical support column 22. Note the upper mounting plate 98 in both figures. As with the second motor 38, the first motor 28 is attached to and suspended from a first gearbox 110, which in turn is attached to and drives a second gearbox 111. Note that beneath the second gearbox 111 are two support brackets 113 for rigidly attaching this motor and gearbox combination to the vertical support column 22. Rotational energy is imparted to the drive shaft 48 via a coupler 112 which provides a plastic interface between the drive shaft 48 and an axle extending from the second gearbox 111. This plastic interface eliminates the opportunity for the metal drive shaft 48 and the metal axle to wear each other down. In one embodiment of the present invention, the second motor 28 is a one-half horsepower motor, and the combined ratio of the two gearboxes 110, 111 is 150:1. The drive gears are sized to enable 14.13 inches of lateral displacement per each drive shaft 48 rotation. The motor speed is such that the system 10 can travel at up to 13.7 linear feet per minute along the wall 12 to be finished.

Figure 13:
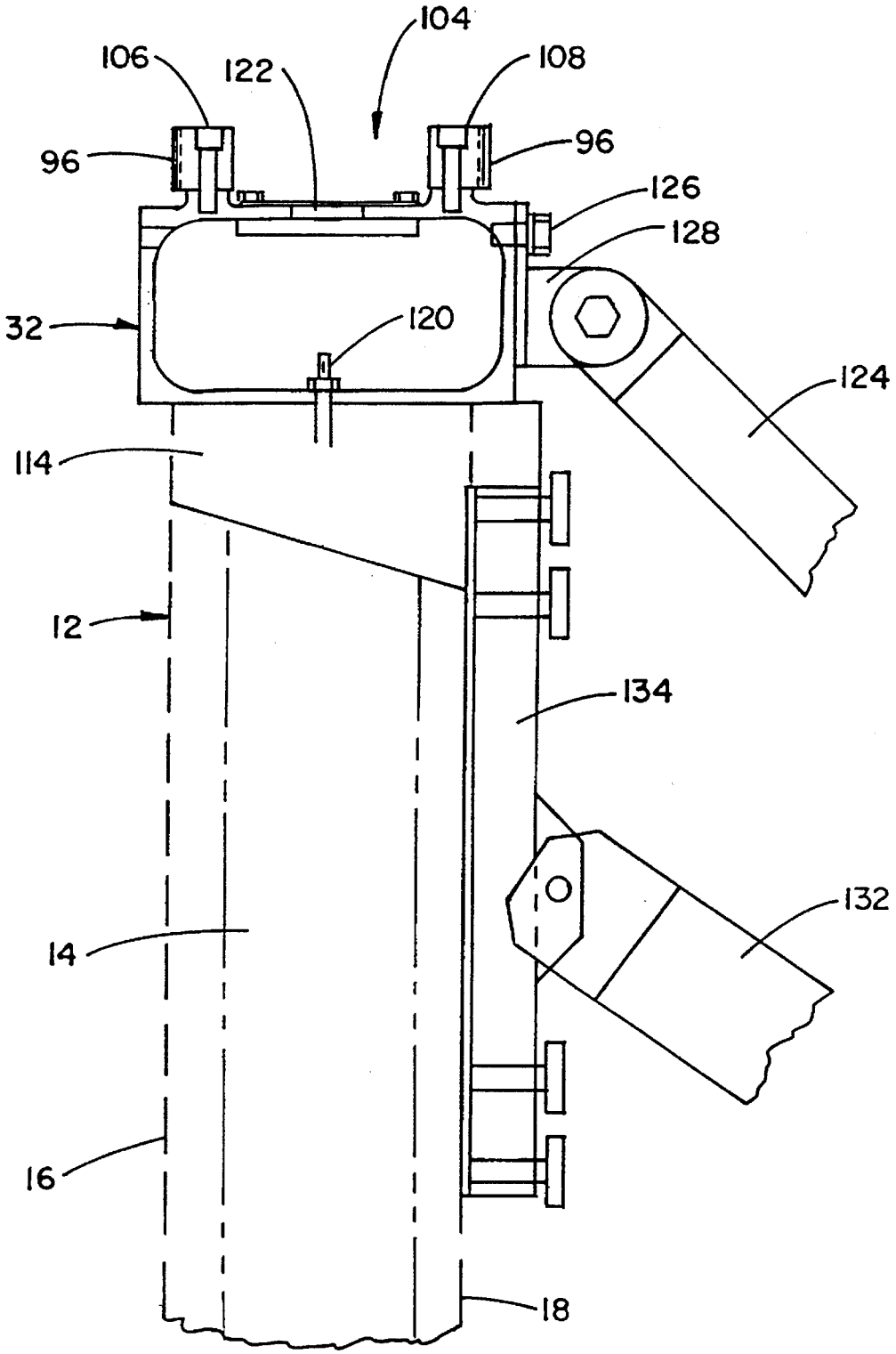
FIG. 13 is a cross-sectional view of an upper portion of the wall system of FIG. 2 rigged for acceptance of the trowelling system of FIG. 1.

In order to keep the upper portion of the vertical support column 22 proximate the wall to be finished 12, a first upper follower wheel 100 and a second upper follower wheel 102 are disposed beneath the upper mounting plate 98. These follower wheels 100, 102 extend within a channel 104, as seen in FIG. 13, and rotate freely to promote smooth progression of the trowelling system 10 in a horizontal direction. The channel 104 has a U-shaped cross-section owing to the presence of two vertical blocks 106, 108 against which the two upper follower wheels 100, 102 contact and roll. Therefore, in the illustrated embodiment of FIGS. 9 and 13, the vertical support column 22 and associated elements will tend to pull away from the wall 12 to the left. However, the first upper follower wheel 100 will press against the first vertical block 106, maintaining the automated trowelling system 10 in vertical alignment with the wall 12, and keeping the second upper drive gear 94 in contact with the upper drive track 96. Adjustments are provided at the attachment point between each upper follower wheel 100, 102 and the upper mounting plate 98 to adjust the spacing of the follower wheels 100, 102 within the channel 104.

The U-shaped channel 104 of FIG. 13 is part of an upper bracket assembly 32 which is disposed atop the wall to be finished 12 and extends the length of the wall. As described with reference to FIG. 2, the wall is comprised of a central core 14, which, in an illustrative embodiment, is made of a styrofoam sheet, disposed between two wire grid screens 16, 18. To affix the bracket 32 to the top of this wall structure 12, a central core material 14 more rigid than styrofoam is required. Consecutive lengths of bracket 32 must be properly aligned to ensure smooth progression of the wall finishing system 10 across the wall 12. Connecting plates (not shown) are disposed in and rigidly connected to the channel 104 of consecutive upper brackets 32.

Figure 14:
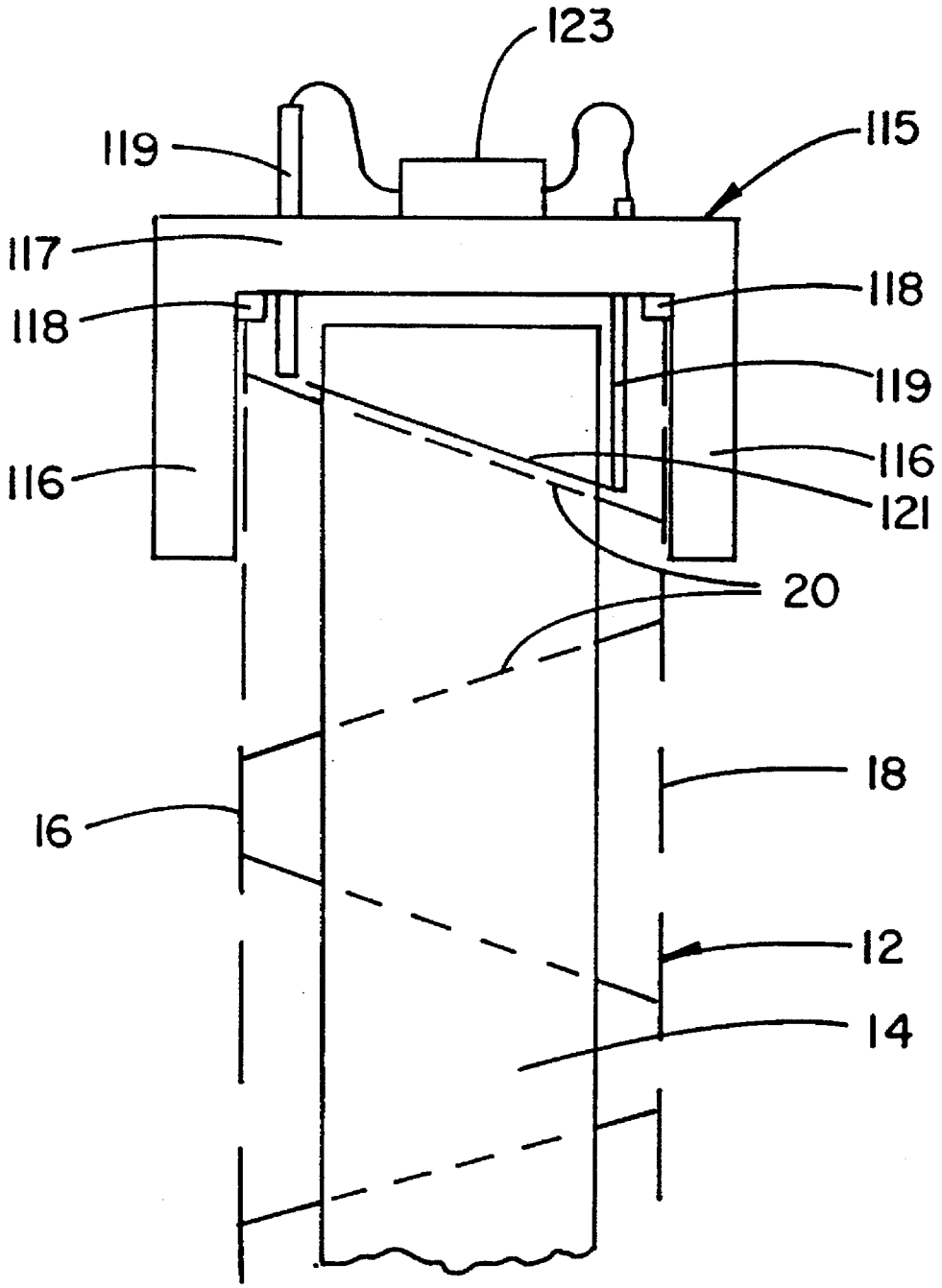
FIG. 14 is a side view of an upper portion of the wall system of FIG. 2 having a cutting frame disposed thereon.

In one embodiment of the present system, an uppermost portion of the styrofoam 14 is removed and replaced with a wood block 114 which provides a solid point of attachment for the upper bracket assembly 32. While styrofoam is an easily cut material, the core 14 of the wall 12 to be finished is difficult to access due to the wire grid screens 16, 18 on either side. Further, cross members 20 are disposed at angles between the grids 16, 18 and through the styrofoam 14. The present invention relies upon a cutting frame 115 disposed atop the wall 12 as shown in FIG. 14. The frame 115 has arms 116 which extend downward from a body region 117 on opposite sides of the wall 12. At the junction of the arms 116 and the body region 117 are disposed plastic runners 118 which enable the frame 115 to be advanced along the top of the wall 12.

Also extending downward from the body region are two height adjustable members 119 having a wire 121 extending therebetween. The wire 121 is heated, by a heat inducing element 123 such as a resistive heater or by an external heat source not an integral part of the frame 115, thus enabling the frame 115 to be advanced along the top of the wall 12 and enabling the heated wire 118 to be drawn through the styrofoam, removing an upper portion thereof. The height adjustable members 119 can be adjusted as appropriate to the geometry of the cross members 20 in the wall 12.

Once a suitable block 114 has been substituted within the wall 12, it is secured to the grids 16, 18 by fasteners such as heavy gauge staples. The upper bracket assembly 32 (see FIG. 13) is then attached to the block 114 by the use of multiple threaded fasteners 120 which are accessed via bore holes 122 in the channel 104. Multiple back-side struts 124 are then attached to the upper bracket assembly 32 on a side of this bracket 32 opposite the vertical support column 22 and the upper drive gears 90, 94. Attachment of each strut 124 to the upper bracket assembly 32 is accomplished by use of threaded fasteners 126 securing a strut plate 128 to the bracket assembly 32. In some applications, it is necessary to perform the disclosed wall finishing on both sides of the wall 12. Thus, the upper bracket assembly 32 is able to accept the strut plate 128 on either side of the bracket 32.

Figure 15A:
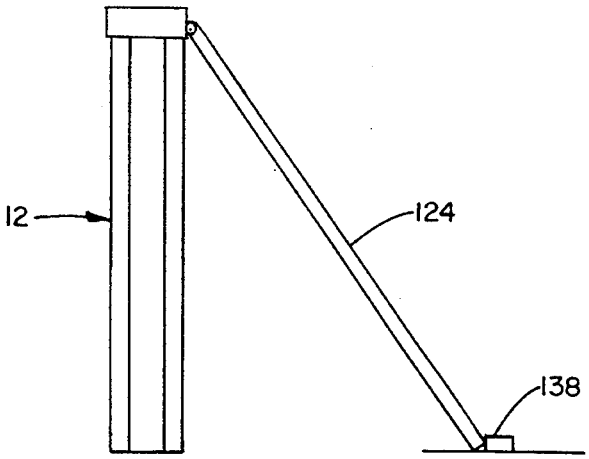
FIG. 15A is a simplified cross-sectional view of the wall system of FIG. 2 having a number of struts of a first type.
Figure 15B:
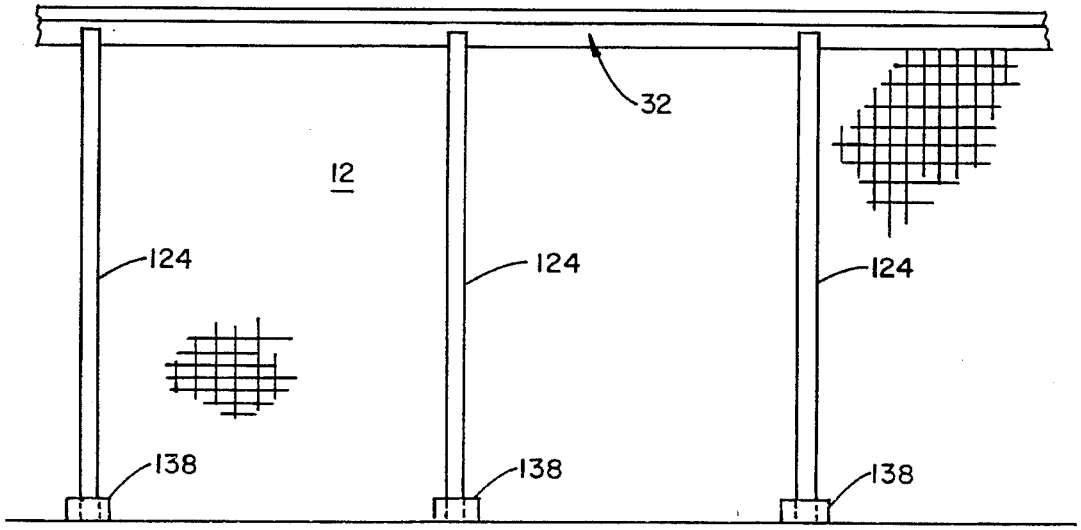
FIG. 15B is a front view of the wall system of FIG. 15A.

In one embodiment, illustrated in FIGS. 15A and 15B, each strut 124 is supported at a lower end by the use of blocks 138 nailed or otherwise secured to the floor or the ground. These struts 124 extend downward in a plane normal to the plane of the wall 12.

Figure 16A:
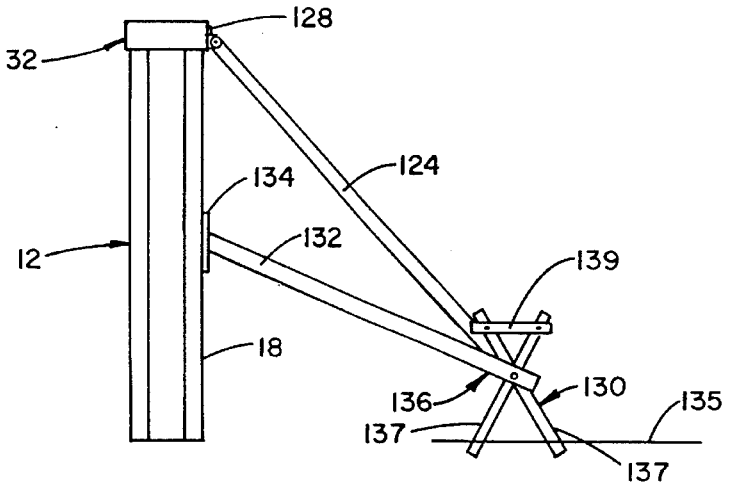
FIG. 16A is a simplified cross-sectional view of the wall system of FIG. 2 having a number of struts of a second type.
Figure 16B:
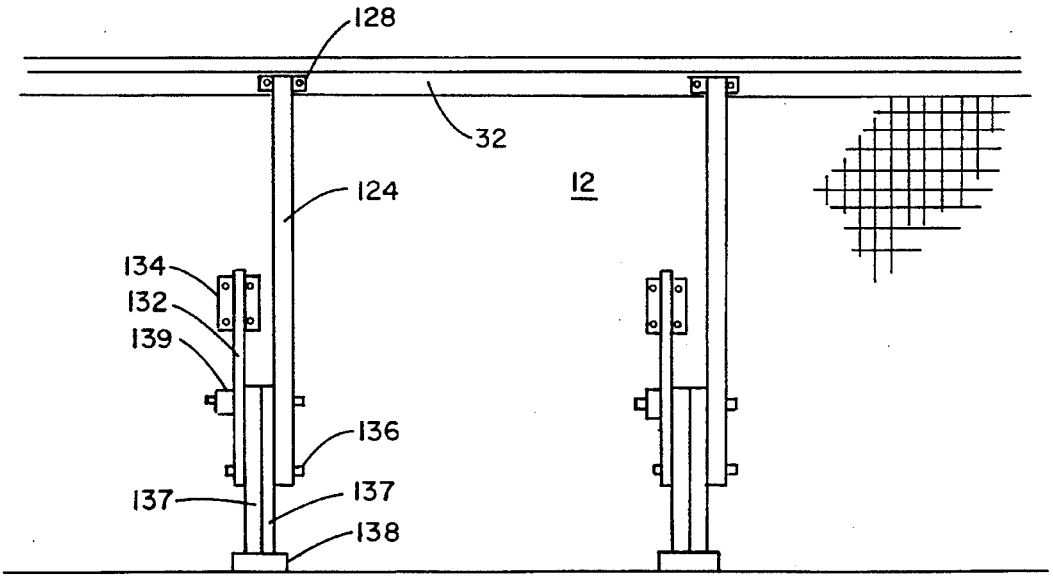
FIG. 16B is a front view of the wall system of FIG. 16A.

In an alternative embodiment, illustrated in FIGS. 16A and 16B, superior structural support for the wall 12 is provided by the use of additional support structures. Each strut 124 is again angled down and away from the upper bracket assembly 32. Intermediate struts 132 are attached to the exterior wire grid 18 at an approximate midway point in the wall 12 vertical dimension. The upper end of each intermediate strut 132 is attached to the exterior wire grid 18 via an intermediate strut plate 134 by the use of hooks having a threaded end. After each hook is looped through the grid 18, a nut is secured onto the threaded end to secure to hook to the strut plate 134. Each intermediate strut 132 extends down and away from the wall 12, in the same plane as that of the main strut 124 normal to the plane of the wall 12. The opposite end of the intermediate strut 132 is attached to the principal strut 124 at a cross-over point 136 approximately one foot above a floor surface 135. Attachment of these struts is by conventional means, such as by a threaded fastener.

Also intersecting at the cross-over point 136 are two secondary struts 137 which forman X-shaped structure 130, all four intersecting struts 124, 132, 137 being coplanar. Lower ends of the secondary struts 137 are disposed in or against the floor surface 135 in a conventional manner, such as by the use of blocks 138 attached to the floor. To further strengthen this configuration, a cross-member 139 is disposed between upper ends of the secondary struts 137.

Figure 17:
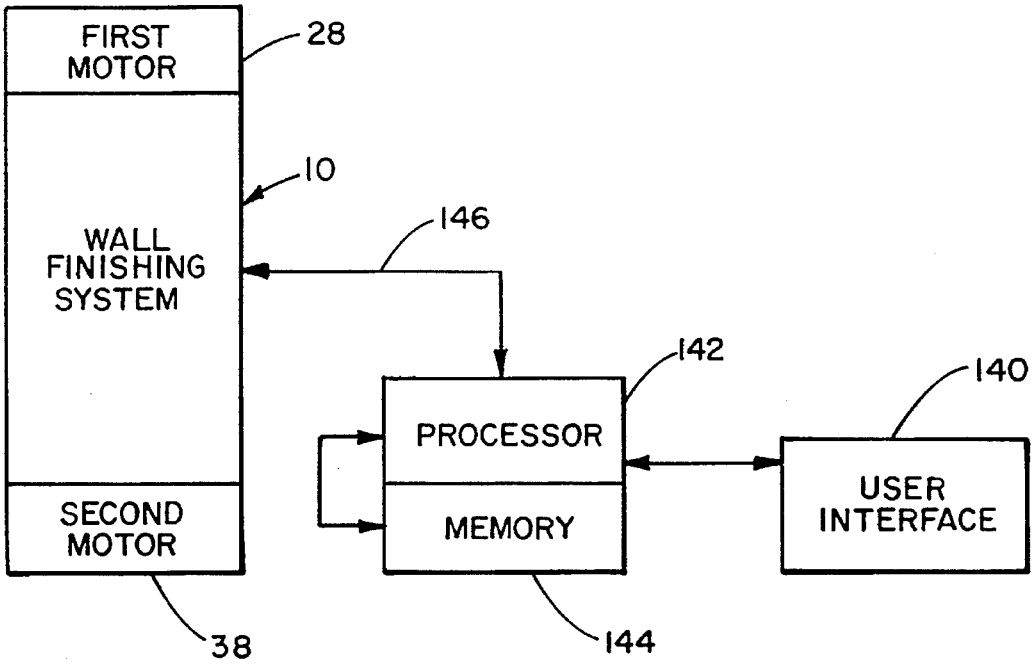
FIG. 17 is a schematic view of a system control configuration for the wall finishing system of FIG. 1.

The automated trowelling system as just described can be controlled by user input, by processor control, or by a combination of both user and processor control. For user control, a user interface 140, otherwise referred to as a remote control device, is in communication with the trowelling system 10 and thus the first and second motors 28, 38. Such communication may be via an RF link, an IR link, or may be via electrical signals conducted along wires between the remote control device 140 and the motors 28, 38. With reference to FIG. 17, user control via the user interface bypasses a processor 142 and connects directly to the trowelling system 10.

Alternatively, if the trowelling system 10 is fully processor controlled or partially processor controlled, such a user interface 140 can provide an operator with the ability to input performance characteristics such as speed or desired surface area to be finished to a processor 142 having an associated memory 144. An exemplary system configuration for a processor controlled system 10 is illustrated in FIG. 17. The user input characteristics are then translated by the processor 142 according to an algorithm stored within the processor memory 144 into commands to the motors 28, 38.

In order to further enable processor-controlled operation of the present wall finishing system, a number of sensors can be utilized. One such sensor is associated with each of the two motors 28, 38 to provide the processor 142 with an indication of motor activity and thus system location along a wall. In an exemplary embodiment, such a sensor provides an indication of shaft rotation, either the motor shaft or a member rotated by the motor, such as the drive shaft 48. Such an embodiment can provide accuracy of 1/60th of a revolution.

In one embodiment, each drive track 52, 96 is ground down at either end of the wall to be finished. Thus, when the trowelling system has reached a corner or a wall end, the system will be unable to continue to move laterally. The first motor 28 will continue to run and turn the lower drive gear 50 and the upper drive gears 90, 94 until stopped either by the processor 142 or by manual intervention.

In an alternative embodiment, another set of sensors are employed in the present system as limit switches disposed at either end of the wall to be finished 12. These switches, which can be rubber enclosed to operate in harsh working environments, provide an indication to the processor 142 that the trowel system has reached one end of a wall and must therefore stop.

The processor 142 and associated memory 144 of the present system can be located, in one embodiment, on a device known as an air track, a self-propelled, compressed-air powered vehicle commonly used in building construction environments. The processor 142, memory 144 and user interface 140 are disposed onboard in ruggedized enclosures, as appropriate to the nature of constructions sites. Cables 146 for power and data transfer are strung between the processor 142 and the trowelling system 10. To avoid the presence of dragging cables 146 which could get caught and crushed in the moving machinery, one or more booms can extend upwards from the air track, with the cables 146 suspended therefrom.

In a first variation of this embodiment, an operator drives the air track and monitors the operation of the automated trowelling system 10 from the user interface 140 onboard the air track. The operator is required to keep the air track in the vicinity of the system 10, though enough slack is provided in the cables 146 to avoid separation of the cables 146 from either the processor 142 or the system 10.

In a second variation of this embodiment, the air track is controlled by commands from the processor 142 based upon position coordinates of the system 10. Thus, in this variation on the automated trowelling system 10, a user need only provide initial wall configurations and specifications as to finishing material, finish desired, amount of time finish material has been on the wall to be finished 12 (finish material age), and ambient conditions, among other data. The trowelling system would then proceed to finish the wall 12 without further manual intervention. In either variation, any suitable vehicle other than an air track can be employed.

In other embodiments, the processor 142 and associated elements are stationary, and cables 146 extend between the processor 142 and the system 10. In this instance, the cables 146 can be straight, coiled, or retractable cables.

Figure 18:
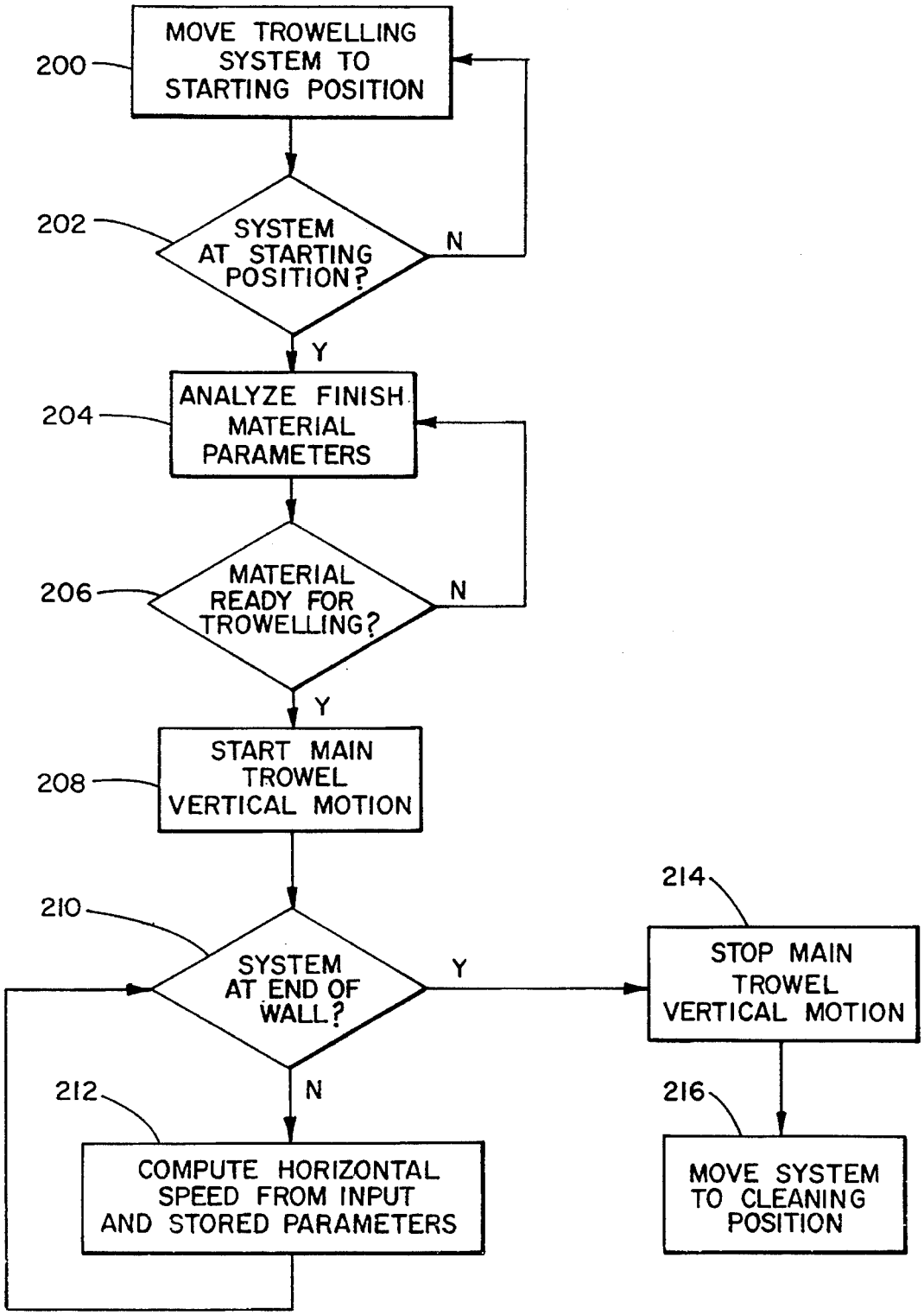
FIG. 18 is a flow chart depicting a sequence of steps executed by a processor associated with the trowelling system of the present invention.

In one embodiment, an operating procedure stored in the memory 144 for execution in the processor 142 is executed as follows and as depicted in FIG. 18. First, the trowelling system 10 is commanded to a starting position (steps 200, 202). In the depiction of FIG. 1, in which the trowelling system is proceeding to the left, such a starting position is the extreme right side of the wall.

As noted, one of the inputs which the processor 142 can receive prior to initiating the trowelling 10 system is the finish material age. The processor 142 can determine from the type of finish material, the thickness of the material and the material age, among other factors, when the trowelling system motors should be activated. Therefore, the processor 142 can idle until the necessary parameter values are achieved (steps 204, 206).

Another data set which can either be entered by a user or which can be calculated by the processor 142 based upon a database of material finishes and conditions is the frequency of main trowel 34 reciprocation. Once the processor 142 has determined that the system 10 motors 28, 38 can be activated (step 206), this frequency is used in controlling the second motor 38 via the cables 146 (step 208). Note that the second motor 38 speed given above (116 rpm) is the rated speed for the motor 38, and not necessarily the speed at which the motor 38 will run continuously.

The automated trowelling system is normally enabled for horizontal motion as long as it has not reached the end of a wall to be finished 12 (step 210). However, other factors must be considered by the processor 142 in controlling the system lateral motion, as now described (step 212).

Figure 19:
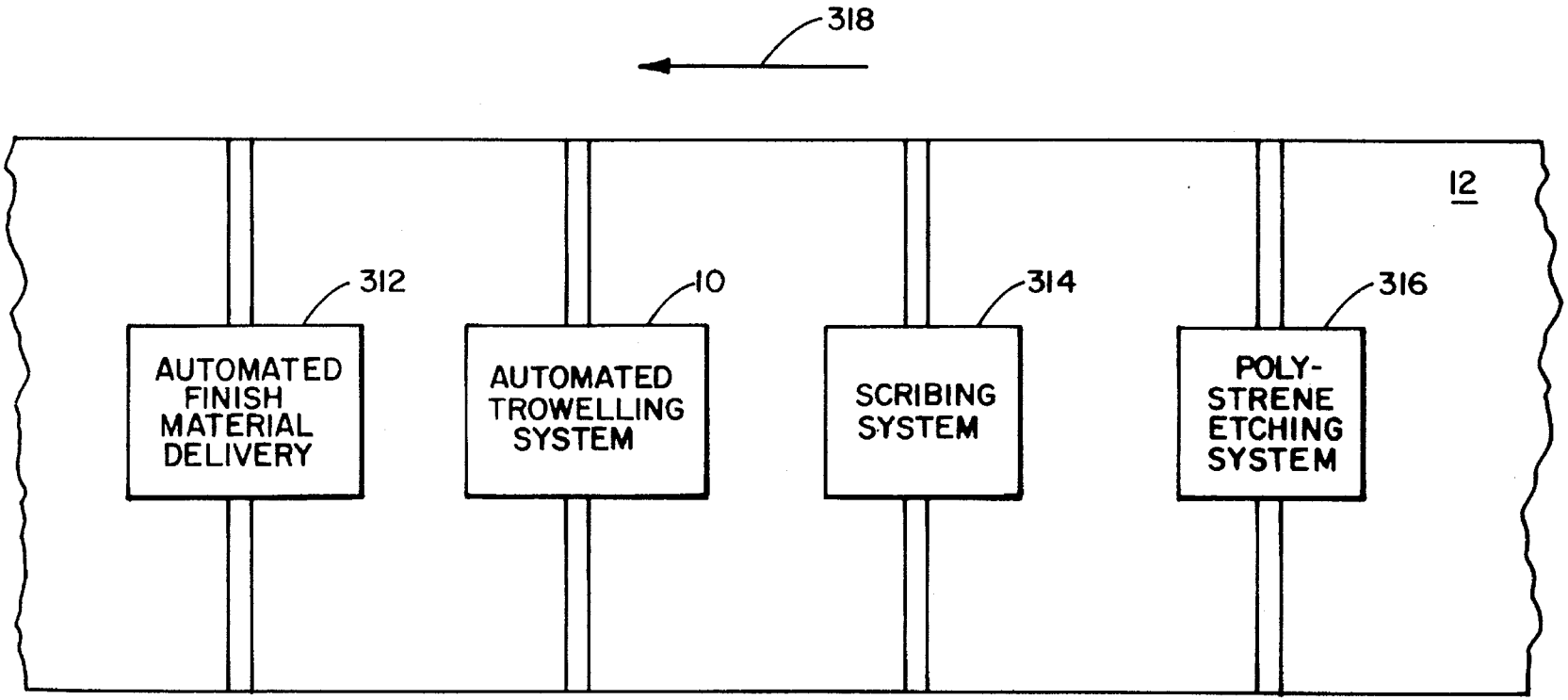
FIG. 19 is a schematic depiction of the automated trowelling system of the present invention as part of a larger wall finishing system.

In an alternative embodiment of the present invention illustrated in FIG. 19, the automated trowelling system 10 is part of a larger system including one or more of: 1) an automated finish material delivery system 312; 2) a scribing system 314 for forming desired grooves in the finished wall 12; and 3) a polystyrene etcher 316 for opening desired gaps or pockets in the finished wall, including through the central layer of styrofoam in the wall system 12. All four of these systems, or any subset thereof, move in one horizontal direction along the wall to be finished 12. In the depiction of FIG. 19, this direction is indicated by an arrow 318.

Therefore, since the present automated trowelling system 10 can operate in conjunction with the finish material delivery system, it is necessary for the processor 142 to calculate the location of the delivery system and to determine the characteristics of the finish material itself, including its age and taking into consideration the ambient conditions, to allow the trowelling system 10 to proceed (step 212).

If the trowelling system 10 proceeds horizontally too quickly, it can gain on the automated delivery system, raising the possibility of a collision between the delivery system and the present automated trowelling system 10. Further, even if the two systems are not close enough for a collision, the possibility exists that cables to the two systems can be entangled. In any case, it is then necessary to stop the lateral progress of the trowelling system until the preceding delivery system has advanced.

Alternatively, the automated trowelling system 10 according to the present invention can approach finish material which has been on the wall system 12 for too short a time, either manually applied to the wall 12 or automatically applied via the delivery system mentioned above. As in the previous situation, the horizontal progress of the automated trowelling system 10 is halted until the finish material has reached the necessary age (step 212). Then, the horizontal speed of the trowelling system 10, as controlled by the first motor 28, is adjusted so that the trowelling system 10 progresses across the material to be finished only as it reaches the proper age.

In a further embodiment of the present invention, the processor 142 can adjust the rate of periodic vertical motion of the main trowel 34 based upon the rate of horizontal progression. Thus, when the horizontal motion is stopped due to below-limit finished material age or due to trowelling system 10 proximity to a finish material delivery system, the frequency of the vertical motion of the main trowel 34 can be decreased, even to zero, if necessary. Conversely, increased horizontal velocity of the trowelling system 10 can result in increased main trowel 34 vertical motion frequency.

Once the trowelling system has progressed horizontally across the wall to be finished 12, the processor 142 commands the second motor 38 and thus the vertical motion of the main trowel 34 to stop (step 214). Next, the first motor 28 of the system 10 is commanded to propel the system 10 to a cleaning position, which can be at either end of the wall 12, or at any point in between (step 216). The trowelling system 10 can then be hosed off with a suitable cleaning agent, which in the case of cement finishing is water. At this point, the trowelling system 10 is ready to be moved to another wall to be finished 12.

In one embodiment of the present automated trowelling system, the processor also controls annunciators such as warning lights and sirens or buzzers to alert personnel in the area that the system is, or is about to be, in motion.

A further embodiment of the present invention employs a shield disposed about the wall finishing system to prevent finishing material and other particulate matter from interfering with the moving elements such as the reel springs 36 or the adjustment handles 64, 68. Such a shield is preferably formed of two aluminum halves, each attached to one of an upper and lower half of the vertical support column 22 and each having essentially three panels. A first panel extends down a side of the vertical support column 22 opposite the wall being finished and parallel thereto. The second and third panels extend from opposite side edges of the first panel to points several inches from other side of the main trowel 34. Between the second and third panels and the trowel 34 is disposed a rubber barrier or skirt capable of deflecting approximately three inches as the main trowel 34 reciprocates up and down.

The lower half of this shield is preferably removably attached to the vertical column 22, thus enabling easy access to the lower brace 24 and associated elements. The upper half need not be so easily removed. Provision is made between the two halves for the second motor 38 and associated gearbox 39 to extend beyond the cover.

As indicated, the lower brace 24 typically has two lower wheels 58, as well as a lower drive gear 50 and other elements described above with respect to FIGS. 3, 4 and 6. Prior to installation of the system against the wall, these elements are likely to be fouled by allowing the system to rest on the floor, which may or may not be finished. Further, the wheels 58, 60 and the lower drive gear 50 may be jarred out of alignment, inhibiting proper movement of the system once installed against the wall 12.

Figure 20A:
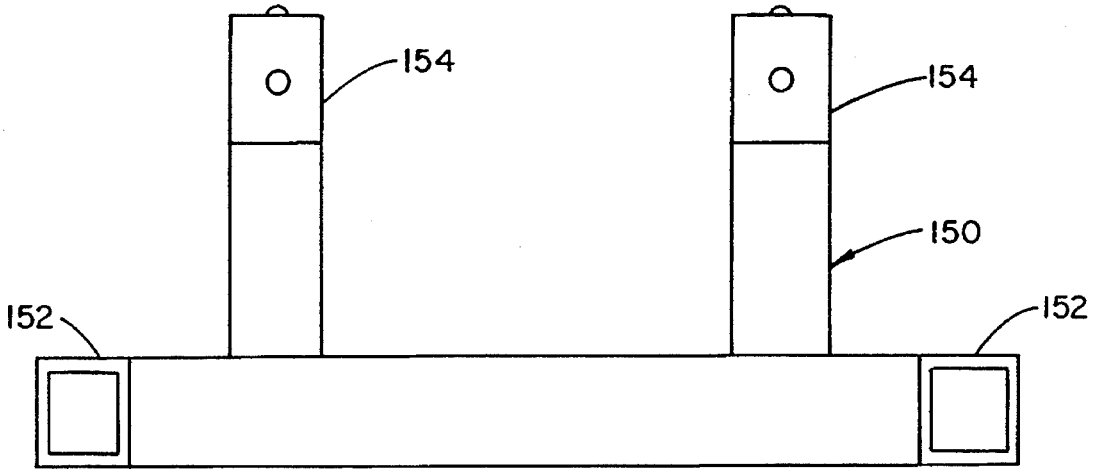
FIG. 20A is a front view of a protective bracket provided to the system of FIG. 1 in an alternative embodiment.
Figure 20B:
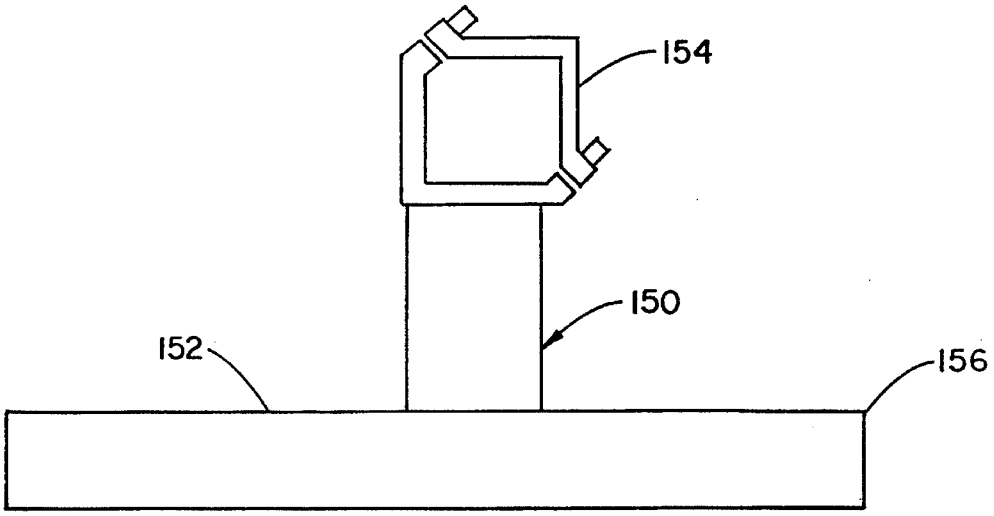
FIG. 20B is a side view of the protective bracket of FIG. 20A.

Therefore, in another embodiment of the present invention, a protective bracket 150 is provided to the lower brace 24 of the wall finishing system via clamps 154 to protect elements attached to the brace 24, as illustrated in FIGS. 20A and 20B. As the system 10 is resting horizontally on the floor, legs 152 are also resting substantially horizontally on the floor, as shown in FIGS. 20A and 20B, elevating the lower brace 24 off the floor. When the system 10 is raised to the vertical (ninety degrees clockwise in FIG. 20B), first ends 156 of the bracket legs 152 extend down onto the floor, once again elevating the brace elements above the floor. From this point, the system 10 is raised onto the wall 12, and the protective bracket 150 can be removed to avoid its protruding into the work area.

These and other examples of the concept of the invention illustrated above are intended by way of example and the actual scope of the invention is to be determined from the following claims.

What is claimed is:

1. A system for providing a finished surface to fluent material applied to a wall, said system comprising:

a support structure disposed on said wall;

a trowel support member suspended from said support structure;

a main trowel disposed on said trowel support member and proximate said wall;

a first drive translating said trowel support member laterally on said support structure with respect to said wall;

a second drive inducing periodic motion in said main trowel parallel with respect to said wall and oblique with respect to motion of said first drive; and a controller associated with said first and second drives.

2. The system according to claim 1, wherein said support structure comprises:

an upper bracket disposed along an upper edge of said wall, said upper bracket having a channel disposed therein; and a lower bracket disposed along a lower edge of said wall, said lower bracket having a ridge element formed therein, said ridge element comprised of an arcuate portion and an underlying portion said upper and lower brackets each having a toothed drive track extending the length of the respective bracket.

3. The system according to claim 2, wherein said trowel support member comprises:

a support column supported by and orthogonal to said upper and lower support brackets, said support column parallel to said wall; and a lower brace member disposed orthogonally at a lower end of said support column and parallel to said wall.

4. The system according to claim 3, wherein said lower brace member is comprised of at least one lower wheel having a groove disposed in a circumferential surface thereof for travel on said arcuate portion of said lower bracket ridge element.

5. The system according to claim 4, wherein said lower brace member is further comprised of at least one follower wheel proximate a respective one of said at least one lower wheel for travel adjacent and beneath said underlying portion of said lower bracket ridge element.

6. The system according to claim 3, wherein said trowel support member further comprises an upper mounting portion disposed proximate an upper end of said support column.

7. The system according to claim 6, wherein said upper mounting portion further comprises at least one upper follower wheel extending from said upper mounting portion and into said channel.

8. The system according to claim 6, wherein said trowel support member further comprises a drive shaft parallel to said main trowel and rotated by said first drive, said drive shaft having an upper drive gear assembly at an upper end thereof and a lower drive gear at a lower end thereof.

9. The system according to claim 8, wherein said upper drive gear assembly comprises:

a first upper gear disposed on said upper end of said drive shaft;

an idler gear disposed on said upper mounting portion in communication with said first upper gear;

and a second upper gear disposed on said upper mounting portion in communication with said idler gear and with said upper bracket drive track, wherein rotation of said drive shaft causes lateral translation of said system with respect to said wall.

10. The system according to claim 8, wherein said lower drive gear is in communication with said lower bracket drive track, and wherein rotation of said drive shaft causes lateral translation of said system with respect to said wall.

11. The system according to claim 1, wherein said main trowel further comprises:

a resilient mount disposed between said trowel support member and said main trowel; and reciprocating linkage disposed between said second drive and said main trowel for imparting said periodic vertical motion to said main trowel.

12. The system according to claim 1, wherein said main trowel further comprises main trowel adjustment members for adjusting a distance between said main trowel and said wall.

13. The system according to claim 1, wherein said system further comprises a forward scoop disposed on a leading edge of said main trowel for removing excess fluent material from said wall.

14. The system according to claim 1, wherein said system further comprises a finish member affixed to said trowel support member for providing a finished texture to said fluent material.

15. The system according to claim 14, wherein said finish member is a non-reciprocating trowel.

16. The system according to claim 14, wherein said finish member is a patterned roller.

17. The system according to claim 14, wherein said finish member further comprises finish member adjustment members for adjusting a distance between said finish member and said wall.

18. The system according to claim 2, wherein said support structure further comprises plural struts extending away from said upper bracket to a floor surface on a side of said wall opposite said trowel support member.

19. The system according to claim 1, wherein said controller is comprised of a processor, an associated memory and a display.

20. The system according to claim 19, wherein said controller is disposed on an air track proximate said system.

21. The system according to claim 1, wherein said controller comprises remote controls connected to said first and second drives for operator control of said system.

22. A wall finishing system for providing a finished surface to solidifiable fluent material applied to a vertical wall, the system comprising:

an upper bracket disposed proximate an upper edge of said wall;

a lower bracket disposed proximate a lower edge of said wall and parallel to said upper bracket;

a vertical support structure suspended from said upper and lower brackets and parallel to a plane defined by said wall;

a main trowel having a planar operating surface parallel said plane defined by said wall, said main trowel disposed on said vertical support structure for vertically reciprocating motion;

a first drive disposed on said vertical support structure for horizontally translating said vertical support structure across said wall in a first direction of motion;

a second drive disposed on said vertical support structure for imparting said vertically reciprocating motion to said main trowel; and a controller for controlling operation of said first and second drives.

23. The system according to claim 22, wherein said vertical support structure comprises:

a vertical support column having an upper end and a lower end;

a horizontal lower brace disposed proximate said vertical support column lower end and parallel said wall defined plane; and an upper mounting plate disposed proximate said upper end of said vertical support column.

24. The system according to claim 23, wherein said upper bracket comprises a horizontal upper drive track having regularly spaced teeth.

25. The system according to claim 24, wherein said first drive comprises:

a vertical drive shaft parallel said vertical support column;

a first motor rotating said vertical drive shaft; and an upper drive gear assembly disposed on said upper mounting plate and actuated by said vertical drive shaft, said upper drive gear assembly having teeth in cooperative engagement with said regularly spaced teeth of said upper drive track.

26. The system according to claim 25, wherein said upper drive gear assembly comprises:

a first upper drive gear disposed on said vertical drive shaft;

an idler gear disposed on said upper mounting plate in mechanical communication with said first upper drive gear; and a second upper drive gear on said upper mounting plate in mechanical communication with said idler gear and said upper drive track, wherein rotation of said vertical drive shaft rotates said second upper drive gear via said first upper drive gear and said idler gear, said second upper drive gear rotation horizontally translating said vertical support structure relative to said upper drive track.

27. The system according to claim 23, wherein said upper bracket further comprises a channel having parallel channel walls.

28. The system according to claim 27, wherein said vertical support structure further comprises at least one upper follower wheel rotatably attached to said upper mounting plate and disposed within said channel for rotation against said channel walls.

29. The system according to claim 23, wherein said lower bracket comprises:

a horizontal lower drive track having regularly spaced teeth; and a ridge surface substantially parallel to said lower drive track, said ridge surface having an arcuate portion and an underlying portion.

30. The system according to claim 29, wherein said first drive comprises:

a vertical drive shaft parallel said vertical support column;

a first motor rotating said vertical drive shaft; and a lower drive gear disposed on said vertical drive shaft and having teeth in cooperative mechanical engagement with said regularly spaced teeth of said lower drive track, wherein rotation of said vertical drive shaft rotates said lower drive gear, said lower drive gear rotation horizontally translating said vertical support structure relative to said lower drive track.

31. The system according to claim 30, wherein said lower brace comprises at least one lower wheel having a groove in a circumferential surface thereof, said groove disposed for rolling engagement with said ridge surface arcuate portion.

32. The system according to claim 31, wherein said lower brace further comprises at least one follower wheel associated with a respective one of said at least one lower wheel, said at least one follower wheel extending from said lower brace proximate said respective at least one lower wheel for rolling engagement with said ridge surface underlying portion.

33. The system according to claim 23, wherein said main trowel further comprises a mounting system disposed between said main trowel and said vertical support column, said mounting system comprised of plural resilient members permitting limited main trowel motion parallel to said vertical support column.

34. The system according to claim 33, wherein said second drive further comprises:

a second motor; and reciprocating linkage mechanically intermediate said second motor and said main trowel, wherein actuation of said second motor imparts reciprocating vertical motion to said main trowel via said reciprocating linkage.

35. The system according to claim 33, wherein said mounting system further comprises a plurality of main trowel adjustment knobs for varying a distance between said vertical support column and said main trowel, and between said main trowel and said wall.

36. The system according to claim 22, wherein said wall finishing system further comprises a forward scoop disposed on said main trowel for removing excess fluent material ahead of said main trowel during motion of said support structure in said first direction.

37. The system according to claim 22, wherein said wall finishing system further comprises a finish element disposed on said vertical support structure, said finish element altering said fluent material finished surface behind said main trowel during motion of said support structure in said first direction.

38. The system according to claim 37, wherein said finish element further comprises attachment system disposed between said finish element and said vertical support structure, said attachment system comprised of finish element adjustment knobs for varying a distance between said vertical support structure and said finish element, and between said finish element and said wall.

39. The system according to claim 37, wherein said finish element is a finish trowel.

40. The system according to claim 37, wherein said finish element is a finish roller parallel said main trowel.

41. The system according to claim 22, wherein said upper bracket further comprises a system of struts disposed on a side of said wall opposite said vertical support structure.

42. The system according to claim 22, wherein said vertical wall comprises:

a planar, intermediate styrofoam layer;

two planar, opposing wire mesh layers, said styrofoam layer disposed between and coplanar with said wire mesh layers; and a plurality of linear cross-members, each of said cross-members having two ends, each of said two ends fastened to one of said two wire mesh layers, said cross-members passing through said styrofoam layer.

43. The system according to claim 22, wherein said controller comprises a processor, an associated memory and a display unit.

44. The system according to claim 43, wherein said controller is disposed on an air track proximate said system.

45. The system according to claim 22, wherein said controller comprises remote controls connected to said first and second drives for direct operator control of said system.

* * * * *